United States Patent [19]

Off et al.

[11] 4,183,514

[45] Jan. 15, 1980

[54] SYSTEM FOR SPREADING FLEXIBLE MATERIAL

[75] Inventors: Joseph W. A. Off, Irving; Judson H. Early, Dallas, both of Tex.

[73] Assignee: Haggar Company, Dallas, Tex.

[21] Appl. No.: 918,649

[22] Filed: Jun. 23, 1978

[51] Int. Cl.[2] ..... B65H 29/46

[52] U.S. Cl. ..... 270/31; 83/488

[58] Field of Search ..... 270/30–31; 83/488–500, 508; 223/37

[56] References Cited

U.S. PATENT DOCUMENTS

| | | | |
|---|---|---|---|
| 417,092 | 12/1889 | Rembert | 100/77 |
| 429,640 | 6/1890 | Rembert | 100/3 |
| 475,117 | 5/1892 | Ivens | 100/77 |
| 502,192 | 7/1893 | Ivens | 100/77 |
| 3,567,211 | 3/1971 | Martin | 270/31 |
| 3,782,649 | 1/1974 | Frederick | 270/31 |
| 3,823,629 | 7/1974 | Bleimund | 83/488 |
| 3,941,366 | 3/1976 | Feld | 270/31 |
| 3,941,367 | 3/1976 | Stumpf | 270/31 |
| 3,951,398 | 4/1976 | Stumpf | 270/31 |
| 3,982,745 | 9/1976 | Weil | 270/31 |
| 4,082,258 | 4/1978 | Smith | 270/31 |

*Primary Examiner*—Paul T. Sewell
*Assistant Examiner*—A. Heinz
*Attorney, Agent, or Firm*—Richards, Harris & Medlock

[57] ABSTRACT

In an automatic system for spreading material, such as fabric, rolled on bolts, a spreading portion includes a driven carriage supported for reciprocal movement over a fixed table and between two spaced catcher assemblies mounted on the table. A tensionless loop is maintained in the material as it is fed from a bolt carried by the carriage and spread over the table. Maximization of the spreading operation without damaging the material is accomplished by making the rate of carriage travel responsive to the rate of material feed. The catcher assemblies prevent the material from following the carriage upon each direction reversal, after which cutting means therein severs each end loop. A storage and loading portion is preferably utilized with the spreading portion. The storage and loading portion includes a conveyor for advancing bolts of material into engagement with an elevator assembly, which reloads the carriage. A microprocessor is utilized to control operation of the entire system. If desired, one of the catcher assemblies can be removably attached to the table to provide for selective material spread lengths.

31 Claims, 42 Drawing Figures

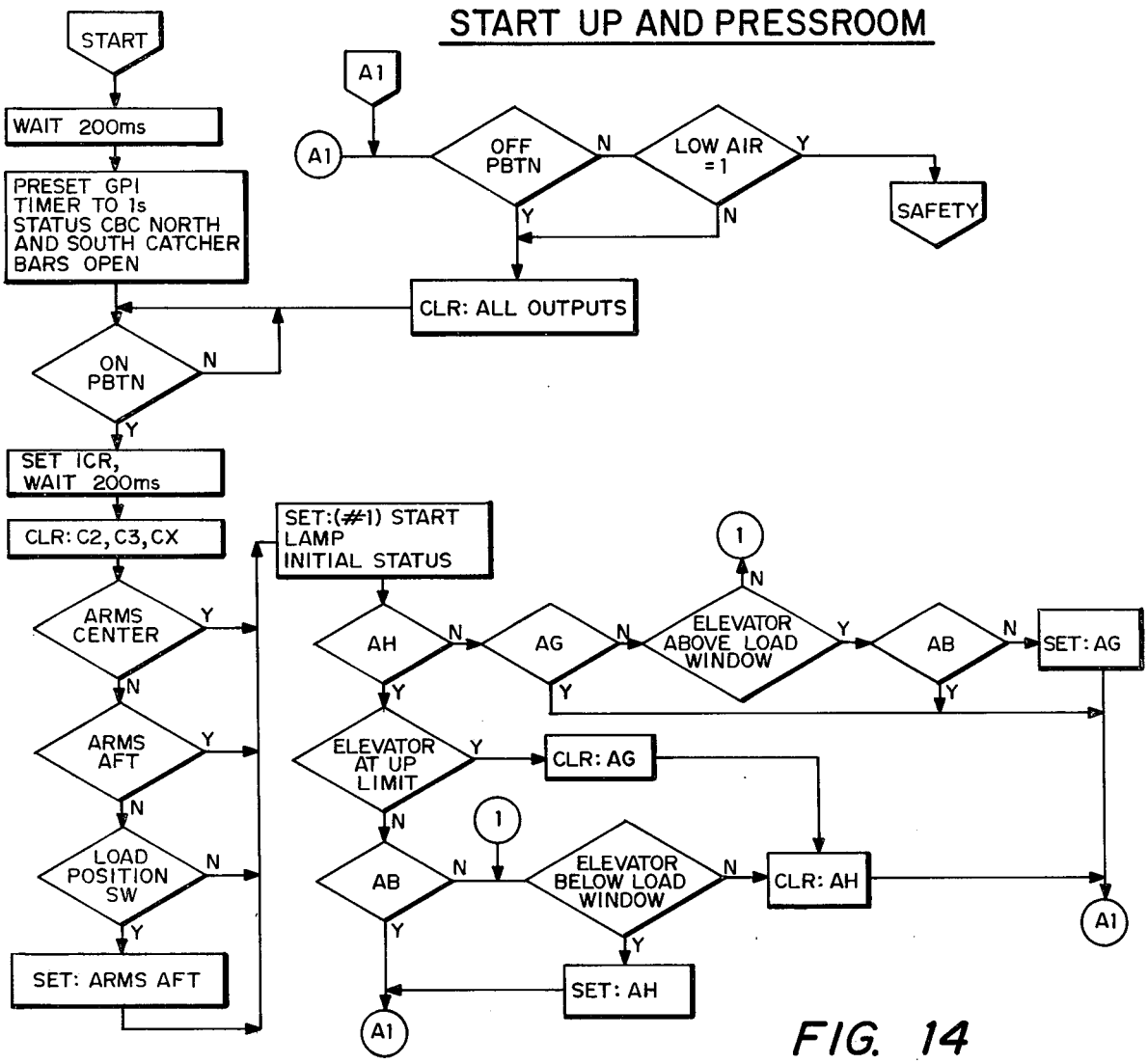

FIG. 14

| LABEL | STATUS |
|---|---|
| START | START-UP. AND PRESSROOM |
| CONV | CONVEYOR AUTOMATIC |
| PBTN | PUSH BUTTON |
| A1 | LOAD BOLT TO ELEVATOR |
| A2 | STOP UP TRAVEL |
| A3 | ALLOW MANUAL |
| A4 | EMERGENCY STOP LAMP ON/OFF |
| A5 | STOP PUSH BUTTON |
| A6 | EMERGENCY STOP CONDITION |
| A7 | #2 MANUAL SWITCH |
| A8 | #3 MANUAL SWITCH |
| A9 | UNLOAD ARBOR |
| AA | ARBOR UNLOADED |
| AB | CARRIERS EMPTY |
| AC | BOLT LOADED |
| ACS | ARBOR CHECK SEQUENCE |
| AD | ARBOR PICK-UP |
| AE | UNLOAD BOLT |

FIG. 13a

| | |
|---|---|
| AF | HOLD FROM CONVEYOR |
| AG | TRAP DOOR CHECK BYPASS |
| AH | UP TRAVEL COMPLETE |
| AJ | DELAY SET |
| AK | SECOND TIME |
| C | MANUAL ELEVATOR SEQUENCE |
| C1 | MANUAL INHIBIT |
| C2 | PUSHER EXTENDED ONCE |
| C3 | PUSHER RETRACTED ONCE |
| C4 | ARBOR |
| C5 | BOLT |
| C6 | CONVEYOR LOAD ONE |
| C7 | CONVEYOR MANUAL |
| C9 | CONVEYOR FORWARD |
| CA | CONVEYOR REVERSE |
| CB | CATCHER BAR |
| CM | CONVEYOR MANUAL SUB-ROUTINE |
| CX | ONE LOAD SEQUENCE COMPLETE |
| CB1 | SOUTH SENSE BYPASS |

FIG. 13b

| | |
|---|---|
| CB2 | NORTH NEAR BYPASS |
| CB3 | SOUTH KNIFE HOME BYPASS |
| CB4 | NORTH SENSE BYPASS |
| CB5 | SOUTH NEAR BYPASS |
| CB6 | NORTH KNIFE HOME BYPASS |
| CB7 | NORTH NEAR |
| CB8 | SOUTH NEAR |
| CB9 | STOP SPREADER |
| CBA | AIRSWITCH = 1 |
| CBB | AIRSWITCH = 1 + PLUG |
| CBC | SOUTH SENSE SKIP |
| CBD | PROPER DISCONNECT |
| CBE | PROPER CONNECT |

FIG. 13c

| | |
|---|---|
| D1 | COMPLETE HOME CYCLE |
| D2 | LOCKS UP SEQUENCE |
| D3 | DATA TRANSFER |
| D4 | HOME |
| DX | DATA TRANSFER ROUTINE |
| EE | CARRIERS EMPTY SEQUENCE |
| EF | LOAD BOLT TO SPREADER SEQUENCE |
| ES | EMERGENCY STOP ENTRY POINT FOR CONDITIONAL STOP |
| LC | LOAD CONVEYOR SEQUENCE |
| M | CATCHER BAR MOVE SAFETY |
| X | EMERGENCY STOP SEQUENCE |

FIG. 13d

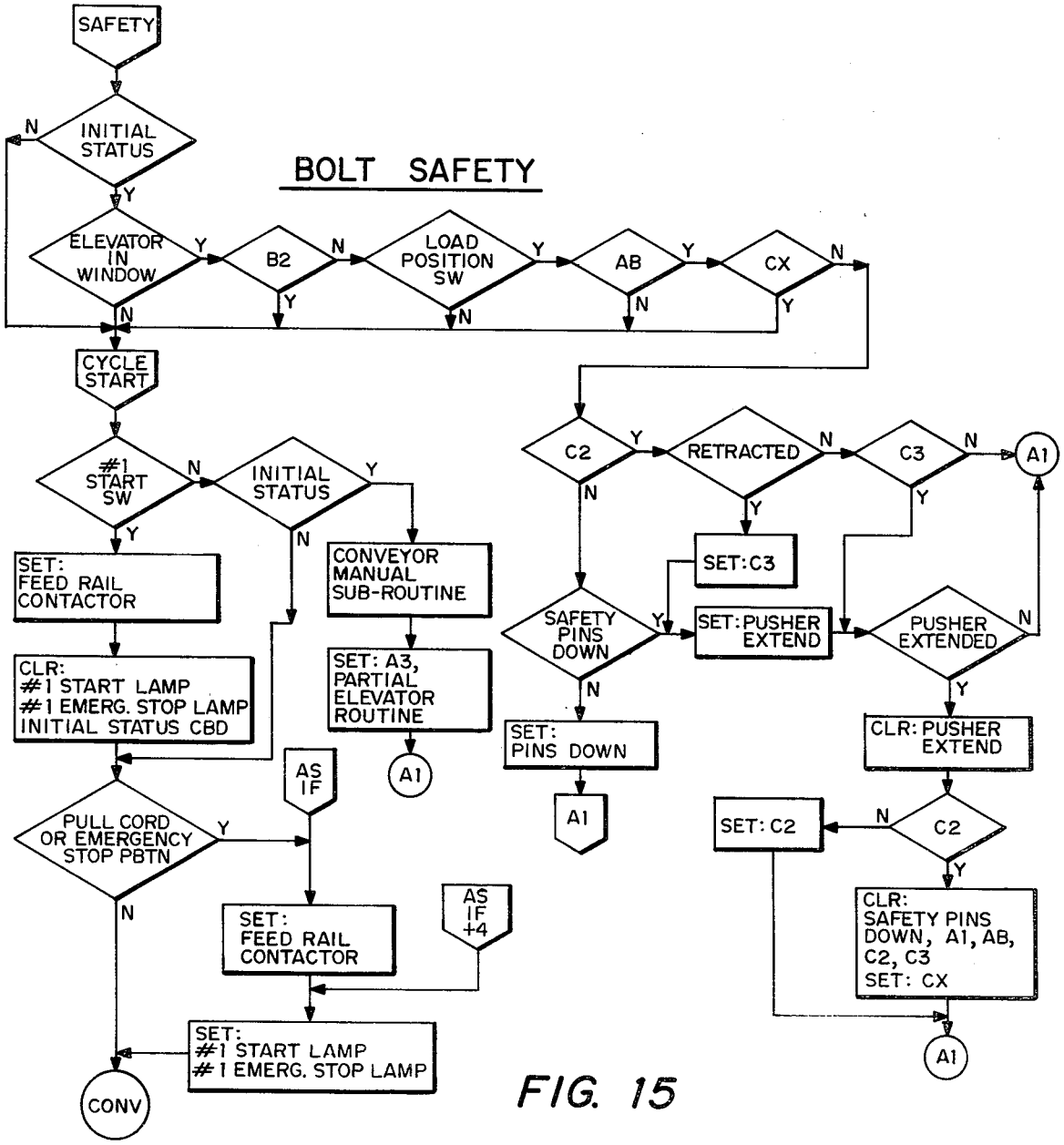

FIG. 15

ARBOR CHECK

LOAD CONVEYOR SEQUENCE

CATCHER BAR MOVE SAFETY
M
CBD
Y
N
A1
CATCHER BAR AIRSWITCH =0
Y
N
CATCHER BAR PLUG IN
N
Y
CBB
N
Y
SET: CBD
CLR: CB9, CBA
AS IF
CBA
N
Y
CB9
Y
N
SET: CBD
CLR: CB9,CBA,CBB
AS IF +4
SC
2s TIMER COMPLETE
N
Y
CLR: CBA
CATCHER BAR AIRSWITCH =1
Y
N
CBA
Y
N
SET: CBA 2s TIMER
2s TIMER COMPLETE
Y
N
SET: CBB
A1
CBA
N
CB

INTERRUPT SUB-ROUTINE AND ITS ROUTINES

SYSTEM FOR SPREADING FLEXIBLE MATERIAL

BACKGROUND AND SUMMARY OF THE INVENTION

The present invention relates generally to a system for spreading flexible material, and more particularly to an automatic system with reload capability for spreading multiple layers of material, such as fabric, in selective spread lengths over a table surface.

For example, in the garment industry individual clothing items are formed by joining various pieces of fabric or cloth materials. The majority of the several pieces comprising a garment of a given size must be cut to corresponding shapes. In times past, each piece of fabric was simply cut with scissors from a length of material. This highly labor intensive approach has been replaced by the simultaneous cutting of multiple layers of fabric, with an electric knife for instance, to produce multiple garment pieces of the desired size and shape. Industries other than the garment industry also utilize the technique of cutting or stamping a plurality of workpieces from multiple layers of material. This results in significant labor and cost savings in the production of finished goods.

Nonetheless, a substantial amount of labor is still required to properly arrange the multiple layers of material for subsequent operations. This can be a time-consuming process since fabric and other types of flexible material can be easily damaged, and therefore requires careful handling. Thus, costs of a different nature are incurred in arranging the layers of material manually, or at best semi-automatically. The problem is further compounded by the fact that many types of flexible material are typically produced and sold in large bolts. These bolts of rolled material may weigh up to several hundred pounds or more and are therefore extremely difficult to handle either manually or semi-automatically.

The present invention comprises an automatic system for spreading material which overcomes the foregoing and other problems long since associated with the prior art. Although the invention is particularly useful for spreading cloth or fabric materials, it will be understood that the invention can be utilized to spread any flexible material including plastic and paper. In accordance with the broader aspects of the invention, the system includes a carriage onto which a roll or bolt of material is loaded. The carriage comprises a movable spreader which straddles a fixed table. An antitension loop is maintained in the material as it is fed onto the table surface from the bolt during travel of the carriage. Catcher assemblies are located on the table at each end of the desired spread length to catch the loop of material each time the carriage reverses direction. Cutting means within each catcher assembly function to sever the end loops between adjacent layers of material. A microprocessor mounted on the carriage is utilized to control the system. By means of the invention, multiple layers of material can be spread automatically and rapidly from a reloadable bolt of material.

In accordance with more specific aspects of the invention, the system preferably comprises a storage and loading portion in conjunction with a spreading portion. The storage and loading portion is positioned above the spreading portion, preferably on a mezzanine level. Bolts of material each having an arbor shaft introduced through the core thereof are loaded on a conveyor for advancement toward an elevator assembly.

The conveyor indexes successive bolts into engagement with an escapement assembly which places the leading bolt onto a spaced pair of fixed elevator arms. The bolt of material is then carried by the elevator assembly downward through an opening in the mezzanine floor to the spreading portion of the system. The storage conveyor is responsive to photosensors which detect the presence of bolts of material with arbor shafts therein to prevent the inadvertent advancement of a bolt lacking an arbor shaft through the elevator opening in the mezzanine floor. Preferably, a trap door assembly is mounted across the elevator opening to positively close the opening except during movement of the elevator assembly.

The spreading portion of the system includes a fixed table, two catcher assemblies mounted at spaced locations on the table, and a movable carriage straddling the table. Before loading the fresh bolt of material onto the carriage, a pair of pivotal transfer arms on the elevator assembly effect removal of the empty arbor shaft from the carriage. The fresh bolt is then placed in cradles on the carriage, after which the elevator assembly moves upward to receive the next bolt of material after dropping the empty arbor shaft from the previously spread bolt into a receptacle on the mezzanine level for collection and reuse.

With a bolt of material loaded and threaded on the carriage, the material is then spread over the fixed table. The carriage straddles the table and is supported on wheels driven by a hydrostatic drive system. The amount of material maintained in a tensionless loop on the carriage is monitored by photosensors. The rate of material feed as well as the rate of travel of the carriage is responsive to the monitored amount of material maintained in the antitension loop so that material is spread at the fastest rate without damaging the material.

The material is spread over the table between the catcher assemblies by the carriage. If desired, one of the catcher assemblies can be removably attached to the table at any one of several predetermined locations therealong to provide for different material spread lengths. A positional feedback assembly generates appropriate signals for use by a microprocessor in controlling the carriage as it reciprocates over the table between the catcher assemblies. Pivotal bars in each catcher assembly engage the loop of material formed when the carriage reverses direction to prevent the material from following. A rotating blade in each catcher assembly then separates adjacent layers of spread material as the carriage travels toward the other catcher assembly. The spreading operation continues without interruption until the bolt carried by the carriage is depleted, at which time the carriage parks beneath the elevator assembly for reloading. Preferably, the fixed table includes an output conveyor positioned beneath a false top so that a previous spread of material can be advanced into a subsequent work station during operation of the system.

DESCRIPTION OF THE DRAWINGS

A more complete understanding of the invention can be had by reference to the following Detailed Description when taken in conjunction with the accompanying Drawings, wherein:

FIGS. 13*a, b, c,* and *d* are explanatory tables of abreviations used in the logic flowcharts; and FIGS. 14–33 are detailed flowcharts of the control logic utilized by the microprocessor employed in the invention.

DETAILED DESCRIPTION

Figure 1:
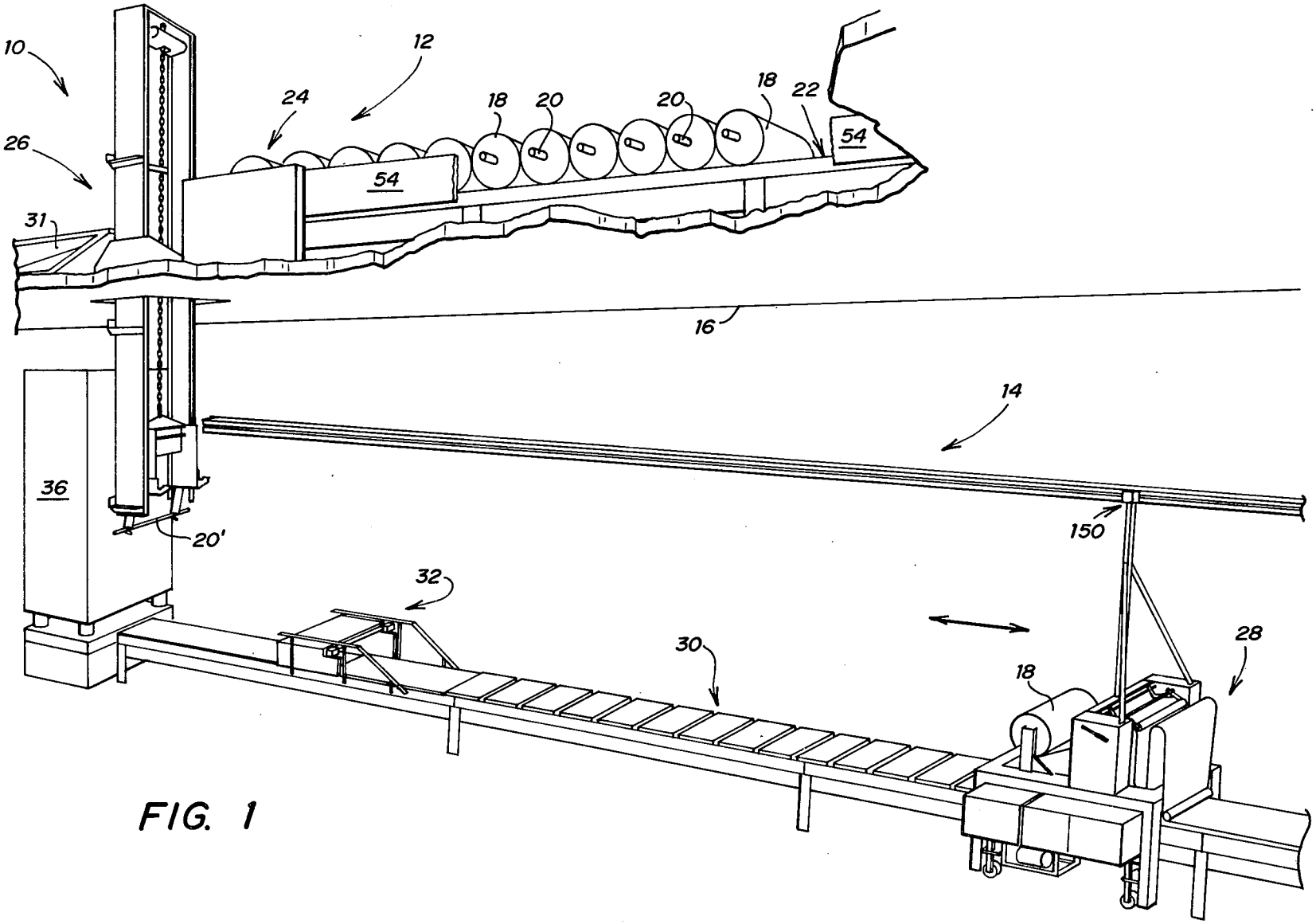
FIG. 1 is a perspective illustration of a system for spreading material incorporating a first embodiment of the invention.

Referring now to the Drawings, wherein like reference characters designate like or corresponding parts throughout the several views, and particularly referring to FIG. 1 thereof, there is shown a system for automatically spreading material 10 incorporating a first embodiment of the invention. System 10 comprises a storage and loading portion 12 together with a spreading portion 14. Storage and loading portion 12 is positioned above spreading portion 14, and preferably on mezzanine 16 according to the preferred construction. System 10 is useful in the automatic spreading of multiple layers of flexible material, such as fabric, plastic, paper and the like.

In the practice of the invention, bolts of material 18 having arbors 20 introduced through the cores thereof are first loaded on conveyor 22 for storage. Conveyor 22 advances each successive bolt 18 into engagement with escapement assembly 24, which places bolt 18 on elevator assembly 26 for downward transport to spreading portion 14. Elevator assembly 26 replaces the spent arbor 20 on carriage 28 with bolt 18, after which the spent arbor 20 is carried upward and deposited in receptacle 31. Material from the loaded bolt 18 is then spread over fixed table 30 as the carriage 28 reciprocates between catcher assemblies 32, only one of which is shown in FIG. 1. The spreading operation continues automatically until depletion of the bolt 18 carried by carriage 28, at which time carriage 28 positions itself beneath elevator assembly 26 for reloading. Use of the system 10 enables rapid, automatic spreading of multiple layers of material for advancement of the spread material into a subsequent work station 36. For example, work station 36 can comprise a stamping press, if desired.

Figure 2:
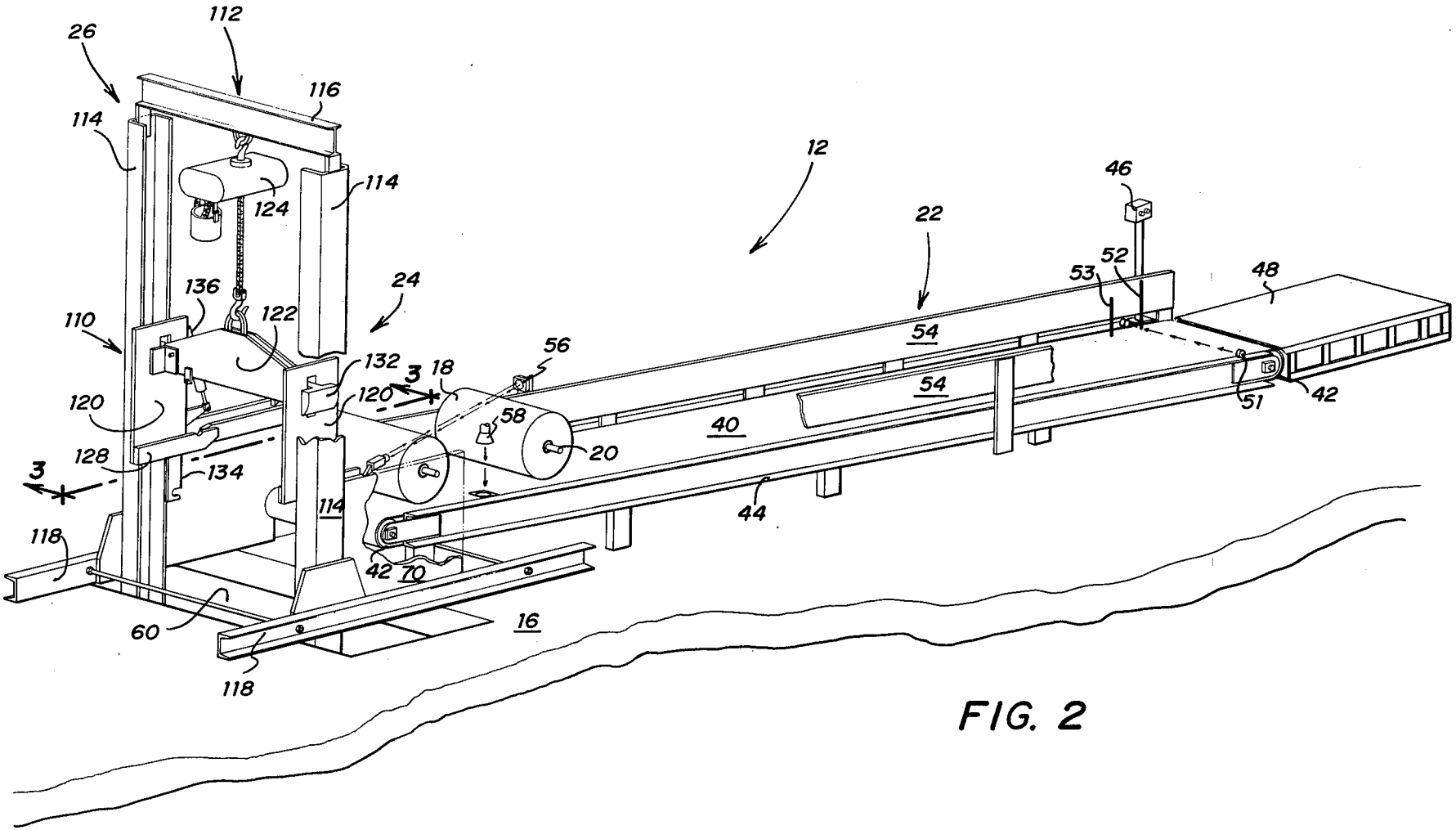
FIG. 2 is a partial illustration of the storage and loading portion of the invention in which certain parts have been broken away to illustrate more clearly certain features of the invention.

Referring to FIG. 2, there is shown the upper part of storage and loading portion 12. Portion 12 includes conveyor 22 comprising an endless belt 40 mounted for movement around a course defined by rollers 42. Rollers 42 are mounted for rotation in frame 44 which is supported on mezzanine 16. Conveyor 22 can be driven by any conventional means, such as an electric motor, the controls for which are located in control station 46 in the preferred construction of the invention.

Bolts 18 of material having arbors 20 introduced through the cores thereof are loaded onto conveyor 22. A loading platform 48 is provided adjacent the input end of conveyor 22 so that bolts 18 can be easily rolled thereonto, after being manually placed on the platform. Preferably, platform 48 includes edge guides (not shown) which center each bolt 18 for placement on conveyor 22.

Conveyor 22 in the preferred construction is responsive to horizontal photosensor 51 and vertical photosensors 52 and 53 located near the input end thereof. Photosensor 51 projects a light beam across the bolt path onto an opposing reflective surface, which reflects the beam back to photosensor 51. A bolt 18 positioned on the input end of conveyor 22 breaks or interrrupts the reflected beam to photosensor 51 signaling the presence of a loaded bolt. Photosensor 52 projects a light beam across the arbor path onto an opposing reflective surface, which reflects the beam back to the photosensor 52. Photosensor 52 thus senses the presence of an arbor 20 in each bolt 18. Photosensor 53 also senses the presence of an arbor 20 in each bolt 18 at a distance further inward on conveyor 22. Accordingly, conveyor 22 advances only when the beams of photosensors 51, 52 and 53 are broken until the beam interruptions thereof are cleared. If only the beam of photosensor 51 is broken, which corresponds to loading of a bolt 18 without an arbor 20, conveyor 22 reverses to reject that bolt. Conveyor 22 will also reverse if the beam of photosensor 53 is not broken. Thus, it will be appreciated that the presence of an arbor in each bolt 18 is double checked upon loading before conveyor 22 automatically advances to allow the loading of another bolt of material.

The desired number of bolts 18 with arbors 20 are indexed by conveyor 22 for successive engagement with escapement assembly 24. Escapement assembly 24 functions to position a bolt 18 carried by arbor 20 onto elevator assembly 26 for subsequent reloading of the carriage 28. Preferably, fences 54 are provided adjacent the sides of conveyor 22 to properly orient the arbor 20 of each bolt 18 for engagement with escapement assembly 24.

In accordance with the preferred construction, lamp/photosensors 56 and 58 are provided along the bolt loading path preceding escapement mechanism 24. Conveyor 22 is responsive to both lamp/photosensors 56 and 58, as well as to photosensors 51, 52 and 53 described hereinbefore. Lamp/photosensor 56 projects a light beam diagonally over and across endless belt 40 onto an opposing reflective surface, which reflects the beam back to lamp/photosensor 56. It will be apparent that one or more bolts 18 positioned between lamp/photosensor 56 and its corresponding reflective surface will break the reflected beam. Consequently, the beam of lamp/photosensor 56 is interrupted whenever at least one bolt 18 is positioned in proximity with escapement mechanism 24. Preferably, lamp/photosensor 56 is connected to a remote indicator, such as a horn, to signal the nonoccurrence of a beam interruption, alerting personnel to check conveyor 22.

It will be understood that the occurrence or nonoccurrence of an interruption in the beam of lamp/photosensor 56 alone will not cause a halt in the advancement of conveyor 22. Lamp/photosensor 58 projects a generally vertical light beam adjacent the inside surface of one of fences 54 onto an opposing reflective surface, which reflects the beam back to lamp/photosensor 58. The beam of lamp/photosensor 58 is positioned for interruption by an arbor 20 only. Consequently, advancement of conveyor 22 is halted if a bolt 18 sensed by lamp/photosensor 56 does not also contain an arbor 20 as detected by lamp/photosensor 58. The presence of an arbor 20 in each bolt 18 is checked at each end of conveyor 22. Thus, the inadvertant advancement of a bolt 18 having no arbor 20 through opening 60 in mezzanine 16 is prevented. Only bolts 18 capable of engaging escapement mechanism 24 are advanced across the output end of conveyor 22.

If desired, lamp/photosensor 58 can also be utilized to count the number of bolts 18 delivered when spreading a predetermined number of bolts with the system 10.

Figure 3:
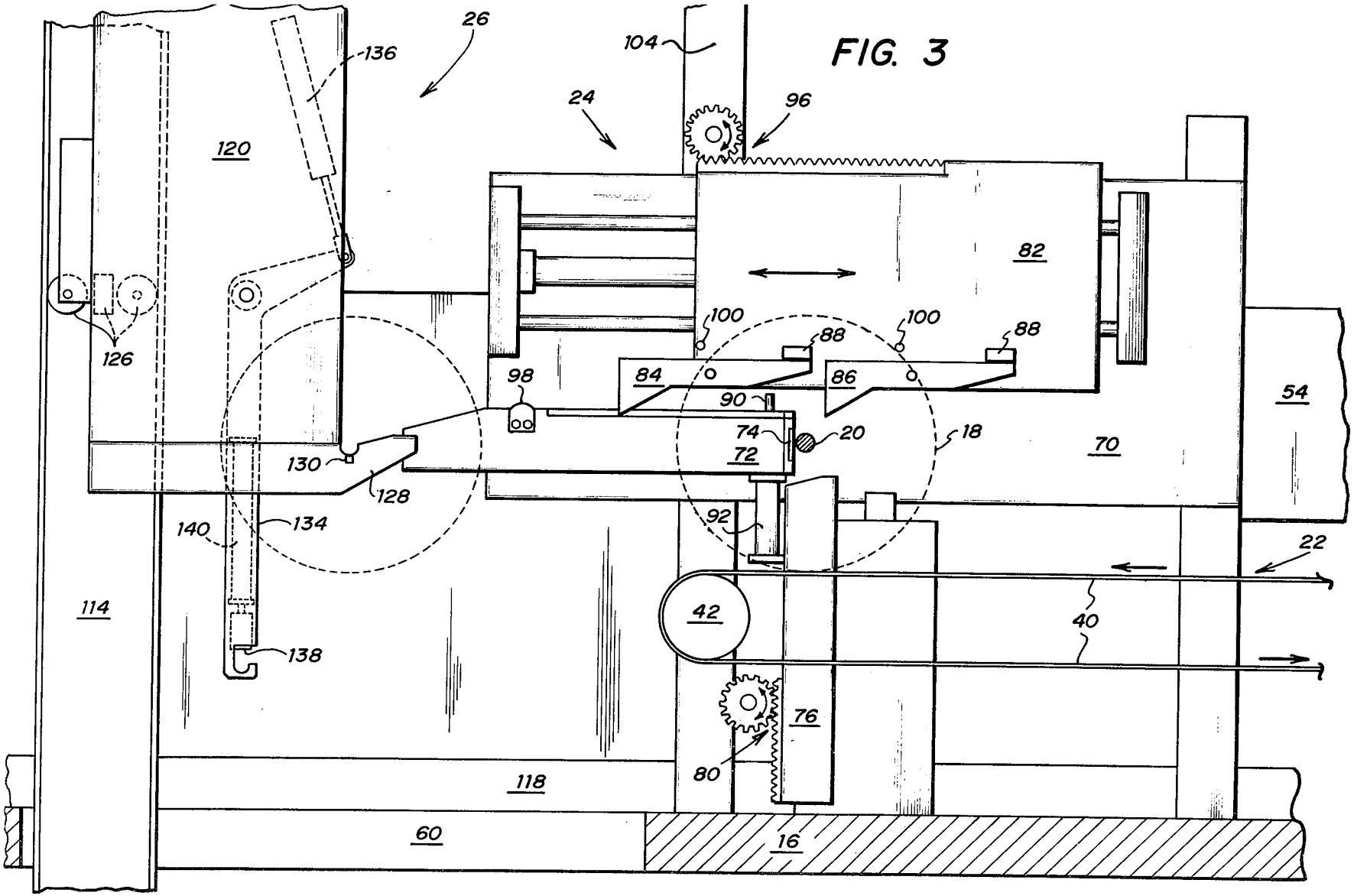
FIG. 3 is a partial vertical section view taken generally along lines 3—3 of FIG. 2 in the direction of the arrows.

Referring now to FIG. 3, there is shown the escapement mechanism 24 which transfers each bolt 18 from conveyor 22 to elevator assembly 26. Escapement mechanism 24 includes a spaced pair of side plates 70 positioned at the output end of conveyor 22 between fences 54 and elevator assembly 26. Preferably, the inside surfaces of side plates 70 are substantially coplanar with the inside surfaces of fences 54 so as to smoothly receive therebetween the arbors 20 of bolts 18. A bolt 18 having an arbor 20 is advanced by conveyor 22 between side plates 70 into engagement with the ends of fixed guides 72. Guides 72, which are attached to the inside surfaces of side plates 70, engage the ends of arbor 20. Sensors 74, mounted on the ends of guides 72 detect the presence of an arbor 20 having a bolt 18 engaged against guides 72. Sensors 74 may comprise, for example, pressure sensitive switches. Conveyor 22 is responsive to sensors 74 so that advancement of conveyor 22 is interrupted upon contact between the ends of arbor 20 and guides 72. Thus, conveyor 22 halts when a bolt 18 having arbor 20 engages guides 72 of escapement mechanism 24.

When it is desired to transfer a bolt 18 to elevator assembly 26, vertical lifts 76 are actuated. Lifts 76 are slidably mounted on the inside surface of side plates 70 beneath and in front of the ends of guides 72. Accordingly, when the arbor 20 of a bolt 18 is positioned against guides 72, the arbor 20 is also positioned above lifts 76. Lifts 76 are actuated to raise bolt 18 by arbor 20 to a position above the upper surface of guides 72. Lifts 76 can be actuated by conventional means, such as double acting cylinders (not shown). Lifts 76 are preferably interconnected with a rack and pinion arrangement 80. By means of rack and pinion arrangement 80, arbor 20 is maintained in uniformly level orientation during the lifting operation. It will be understood that raising arbor 20 in this manner does not disturb bolt 18 laterally, whereby bolt 18 remains centered on arbor 20.

With arbor 20 raised to a height parallel with or slightly above the upper surface of guides 72, horizontal shuttles 82 are then actuated. Shuttles 82 are slidably mounted for horizontal movement above guides 72 on the inside surfaces of side plates 70. Each shuttle 82 includes first and second pawls 84 and 86 mounted thereon for pivotal movement about horizontal axes. Stops 88 secured to shuttle 82 function to normally position the forward ends of pawls 84 and 86 adjacent the upper surfaces of guides 72. Just prior to actuation of shuttles 82, stop pins 90 are retracted by double acting cylinders 92. Stop pins 90 extend from the upper surface of stops 72 and function to halt any undesirable forward rolling movement of arbor 20 after the lifting operation. Thus, stop pins 90 prevent development of a skew condition between arbor 20 and guides 72, which could cause bolt 18 and arbor 20 to drop off guides 72.

With stop pins 90 retracted, shuttles 82 are driven forward to advance arbor 20 carrying bolt 18 along guides 72. Shuttles 82 can be driven by conventional means, such as double acting cylinders (not shown). Preferably, shuttles 82 are interconnected by a rack and pinion arrangement 96. Rack and pinion arrangement 96 enables the uniform horizontal advancement of each end of arbor 20 to eliminate the possible development of a skew condition between arbor 20 and guides 72. Second pawls 86 on shuttles 82 first engage and advance arbor 20 forward to an intermediate position on the opposite side of retracted stop pins 90. On the return stroke of shuttles 82, first pawls 84 ride up and over the ends of arbor 20 to a position on the other side thereof. Upon the second stroke of shuttles 82, first pawls 84 push bolt 18 by arbor 20 the remaining distance for placement on elevator assembly 26. Preferably, keepers 98 are provided near the forward ends of guides 72 for retention of bolt 18 between strokes of shuttles 82. In accordance with the preferred construction, pins 100 are preferably provided on shuttles 82 to limit pivotal movement of pawls 84 and 86 during the return portion of the cycle.

It will thus be apparent that escapement mechanism 24 features a pair of vertical lifts 76 which raise a bolt 18 from conveyor 22. Shuttles 82 then push the bolt 18 by arbor 20 to an intermediate position on guides 72 before placement onto elevator assembly 26. In practice it has been found desirable to raise bolt 18 vertically with a single stroke, after which bolt 18 is pushed horizontally with a double stroke. A double stroke operation in the horizontal portion of escapement mechanism 24 reduces the size of the mechanism while permitting the management of bolts 18 having substantial size.

Referring again to FIG. 2 in conjunction with FIG. 3, there is shown elevator assembly 26 which receives bolt 18 and arbor 20 from escapement mechanism 24. Elevator assembly 26 comprises a carriage 110 mounted for vertical movement within a frame 112. Frame 112 includes a spaced pair of side channels 114 interconnected at the top by cross beam 116. Channels 114 are supported by beams 118 positioned on mezzanine level 16. Channels 114 extend through floor opening 60 toward spreading portion 14. Carriage 110 consists of a pair of spaced side members 120 interconnected with a cross member 122. Carriage 110 is supported from frame 112 by chain hoist 124 connected between cross beam 116 and cross member 122. In accordance with the preferred construction, chain hoist 124 is of the electrically actuated type. As is best shown in FIG. 3, rollers 126 are mounted between side members 120 and channels 114 to facilitate travel of elevator carriage 110 within frame 112.

Carriage 110 further includes a pair of fixed arms 128 for receiving an arbor 20 supporting bolt 18 therebetween. Arms 128 extend substantially horizontally from side members 120 between and adjacent to the ends of guides 72. Sensors 130 on arms 128 detect when an arbor 20 carrying a bolt 18 is received from escapement mechanism 24. Sensors 130 can comprise, for example, pressure sensitive switches. Chain hoist 124, which is responsive to sensors 130, then lowers carriage 110 and bolt 18 down through opening 60. Preferably, carriage 110 further includes safety brakes 132 of the spring assisted cam activated type. In the event of a failure in chain hoist 124, safety brakes 132 would engage channels 114 to arrest or at least impede the uncontrolled descent of carriage 110.

Figure 4:
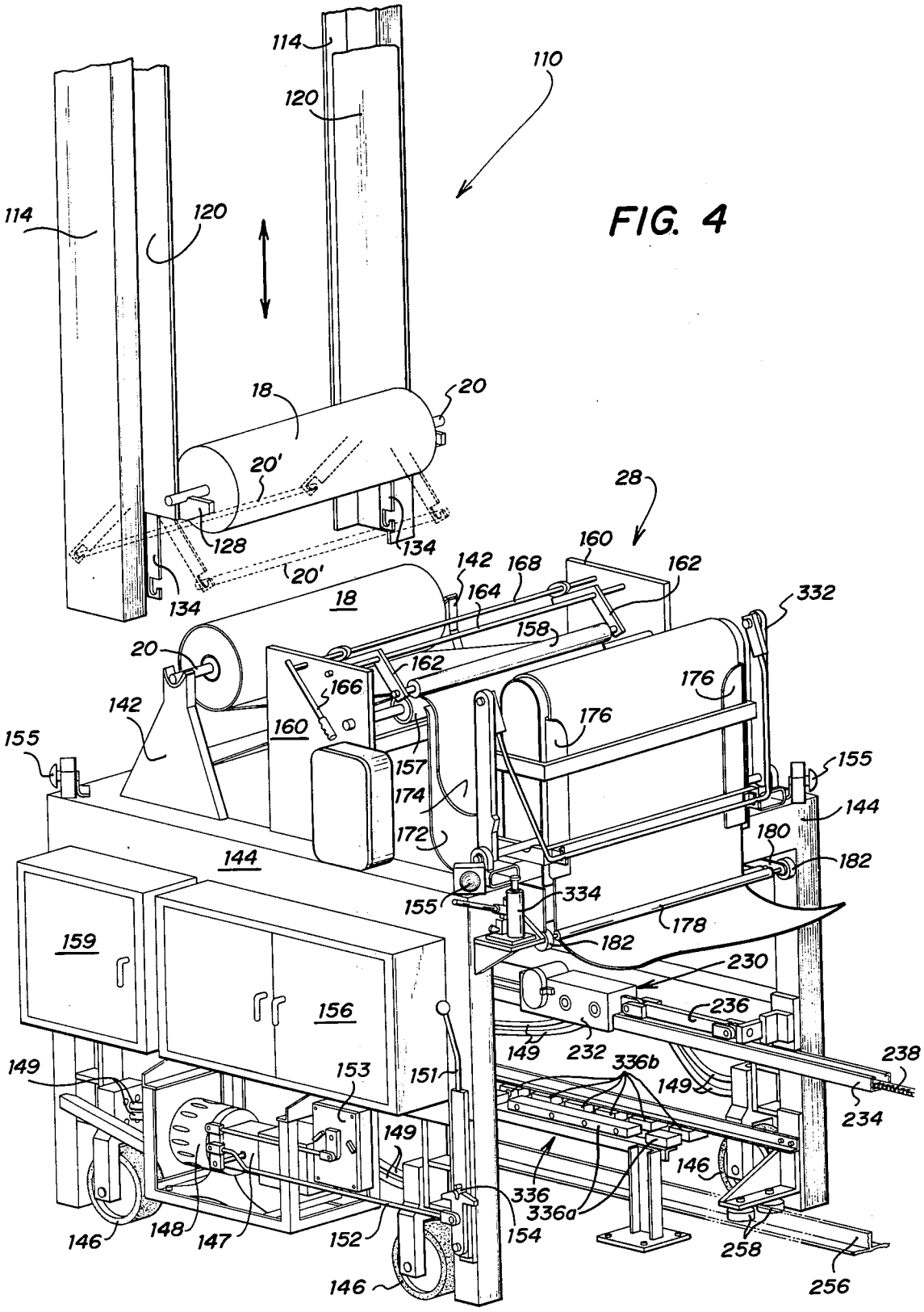
FIG. 4 is a perspective illustration of the carriage portion of the invention.

Referring now to FIG. 4 in conjunction with FIG. 3, a bolt 18 and arbor 20 are transported by elevator assembly 26 to a position in proximity with spreading portion 14 below. For clarity in FIG. 4, table 30 has been omitted. Carriage 110 preferably stops in a dwell position slightly lower than that shown in FIG. 4 to await a reload command from the microprocessor carried onboard carriage 28.

After carriage 28 parks itself beneath elevator assembly 26, the reload sequence sequence begins. Before loading bolt 18 onto carriage 28, previously spent arbor 20′ is first removed by transfer arms 134, which are pivotally attached to side members 120. Transfer arms 134 are actuated by double acting cylinders 136 coupled thereto. Transfer arms 134 are normally carried in a substantially vertical position as shown in full lines. Cylinders 136 pivotally actuate transfer arms 134 forward as shown in phantom lines to engage arbor 20′. Slides 138 provided on arms 134 are then actuated by double acting cylinders 140 to lock empty arbor 20′ onto the transfer arms. It will be understood that other catch means can be utilized to selectively secure arbor 20′ and arms 134. Elevator carriage 110 then moves upwardly a sufficient distance to allow pivotal movement of transfer arms 134 with arbor 20′ to a rearward, noninterfering position shown in phantom lines in FIG. 4.

Carriage 110 then moves downwardly again to deposit arbor 20 with bolt 18 into cradles 142 of spreader carriage 28. It will be apparent that after depositing bolt 18 and arbor 20 onto cradles 142, fixed arms 128 are positioned below deposited arbor 20, at which point carriage 28 is moved out of interference therewith. Transfer arms 134 with arbor 20′ resume their central positions shown in full lines in FIG. 4 preparatory to passage through opening 60 in mezzanine 16. Chain hoist 124 shown in FIG. 2 then pulls elevator carriage 110 up to the mezzanine 16, where it is reloaded and arbor 20′ is discharged. Specifically, transfer arms 134 are pivoted backward again to position spent arbor 20′ above receptacle 31 shown in FIG. 1. Deactuation of slides 138 drops arbor 20′ into receptacle 31 for collection and reuse.

Having reference to FIG. 4, there is illustrated spreader carriage 28 which spreads the material from bolt 18 over table 30 (not shown). Carriage 28 includes a frame 144 with four legs and straddles table 30, as is best shown in FIG. 1. In accordance with the preferred construction, hollow steel tubing is utilized to construct frame 144. Rubber tired wheels 146 located on each of the legs of frame 144 support carriage 28 on the floor for translation over table 30.

The drive system for carriage 28 comprises hydraulic pump 147 driven by electric motor 148, which is connected to a suitable source of power. Pump 147 has forward, neutral and reverse capability; while motor 148 is unidirectional to provide for variable speed of the carriage in two directions. The output of hydraulic pump 147 is directed through conduits 149 to a hydraulic motor located in each wheel 146. Accordingly, power transmission by means of hydraulic fluid flow from pump 147 to wheels 146 constitutes the hydrostatic drive system which propels carriage 28.

Referring momentarily back to FIG. 1, in conjunction with FIG. 4, electrical power for carriage 28 is supplied by means of a conventional tower and suspended electrical rail arrangement 150. For clarity, arrangement 150 has been omitted from FIG. 4. Carriage 28 is also equipped with controls for the manual operation thereof. Handle 151 couples through linkage 152 to servomotor 153 geared to the control arm of pump 147. Manipulation of handle 151 enables an operator to manually control propulsion of carriage 28. Stops are preferably included with servomotor 153 to limit the maximum manual speed signal delivered to the hydrostatic drive system. During automatic operation of carriage 28, handle 151 is secured in a neutral position by detent 154. Safety switches 155 are also provided at each corner of carriage 28. Each safety switch 155 is connected to a microprocessor contained in cabinet 156. As will be described more fully hereinafter, the microprocessor receives electrical power from carriage power supply box 159 connected to arrangement 150 shown in FIG. 1. Actuation of one of the switches 155 initiates orderly shutdown and stoppage of the carriage 28 and its components.

Before commencement of the automatic spreading operation, the fabric from bolt 18 must first be threaded manually through carriage 28. It will thus be understood that the threading of material from bolt 18 and the loading of bolts 18 onto conveyor 22, are the only steps requiring manual intervention during operation of system 10.

Figure 5:
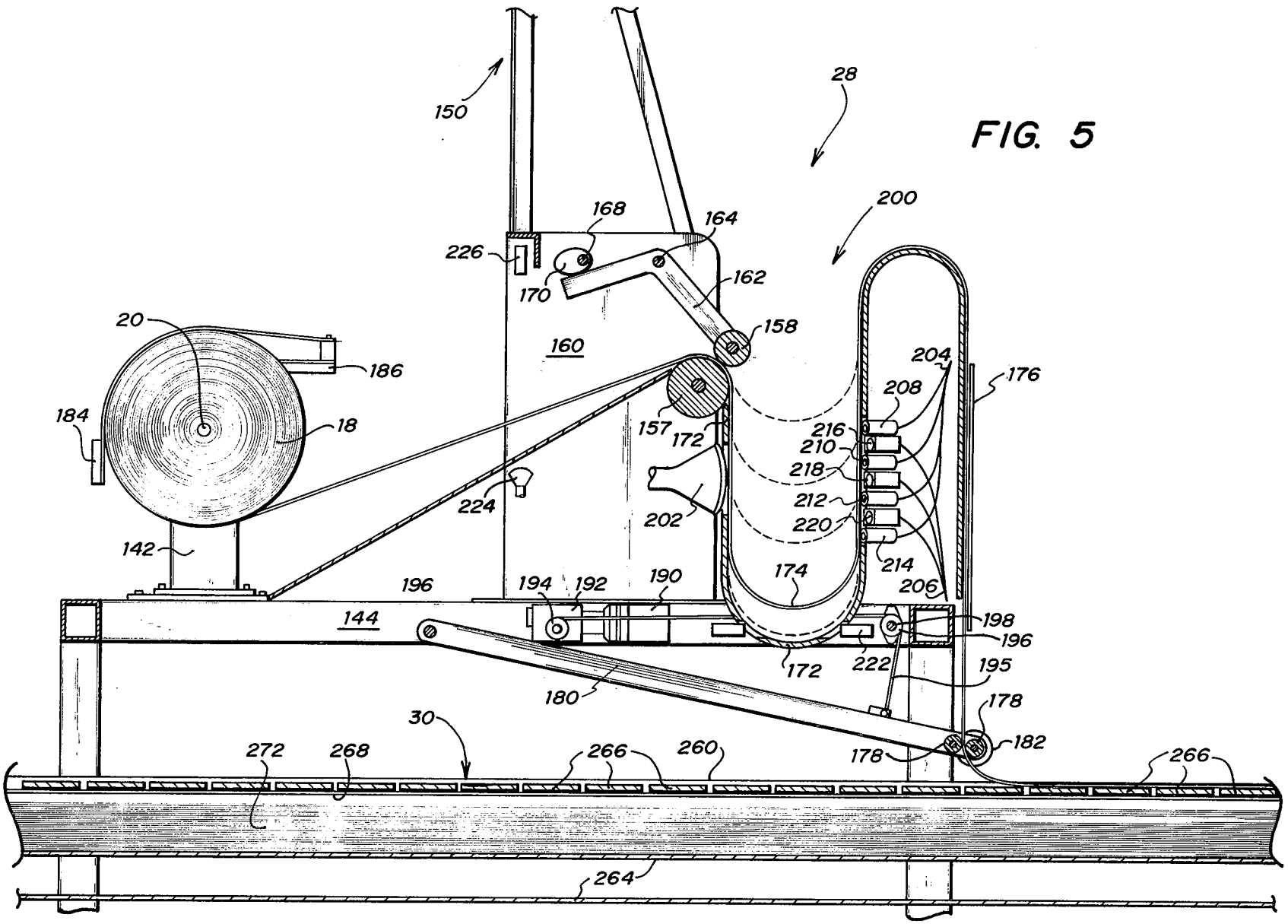
FIG. 5 is a partial side view of the carriage and table in which certain parts have been broken away to illustrate more clearly certain features of the invention.

Turning now to FIGS. 4 and 5, material from bolt 18 is first directed between rollers 157 and 158 of carriage 28. Feed roller 157, which is mounted for rotation between supports 160, is driven by a conventional variable speed motor (not shown) through a conventional speed reducer (not shown). Preferably, the exterior surface of feed roller 157 is coated with a resilient material, such as rubber, so that the material from bolt 18 is engaged without slippage between rollers 157 and 158. Idler roller 158 is mounted for rotation between pivot arms 162, which are affixed to shaft 164 rotatably carried between supports 160. Preferably, idler roller 158 is relatively heavy so as to press the material from bolt 18 firmly into engagement with feed roller 157. Since idler roller 158 is relatively heavy, lever 166 secured to shaft 168 is provided with cams 70 engaging arms 162 to facilitate lifting of idler roller 158 away from feed roller 157 during the threading operation. Pivotal movement of lever 166 raises idler roller 158 by mechanical advantage.

Feed roller 157 advances the material from bolt 18 into scray 172, in which a tensionless loop 174 of flexible material is maintained for payout through guides 176 and between rollers 178. Scray 172 comprises a generally S-shaped form mounted on frame 144 and extending across the fabric path in front of rollers 157 and 158. Scray 172 is preferably constructed of a smooth material, such as polished stainless steel, to prevent snagging of the material thereon. The material from bolt 18 is fed into scray 172 at a rate corresponding to the rate at which the material leaves scray 172. Guides 176 are provided for aligning the edges of the material relative to table 30 during the spreading operation. Preferably, guides 176 are slidably mounted for adjustment according to the particular width of material fed from bolt 18. After being aligned by guides 176, the material is finally directed into engagement with table 30 between spaced, parallel output rollers 178.

Rollers 178 are mounted for rotation between arms 180, which are pivotally attached to frame 144. Arms 180 include wheels 182 rotatably carried at the forward ends thereof for engagement with stationary structure, as will be more fully described hereinafter, to provide a means for controlling the height of rollers 178 with respect to table 30 and catchers 32. In one embodiment, stops (not shown) are utilized to limit the lowermost position of arms 180 under gravity. It will thus be understood that the material from bolt 18 is manually threaded between rollers 157 and 158, through scray 172, and between guides 176 and payout rollers 178 before initiation of the spreading operation. If desired, drag straps 184 extending from brackets 186 attached to cradle 142 can be provided for placement over bolt 18 to reduce backlash during the spreading operation.

According to the preferred construction of carriage 28, downward pivotal movement of arms 180 is incrementally controlled. FIG. 5 shows a step-servo motor 190 coupled through a right angle gear reducer 192 to a sprocket 194. Motor 190 and gear reducer 192 are preferably mounted to one side of carriage 28. Chain 195 is rigidly secured at one end to sprocket 194. Chain 195 extends over sprocket 196 and is connected to one of the arms 180. Sprocket 196 is secured to shaft 198 which is rotatably supported across carriage 28. The other arm 180 is supported by another chain (not shown) coupled to a sprocket (not shown) mounted on the other side of shaft 198. Actuation of motor 190 causes a predetermined length of chain 195 to become wrapped on sprocket 194. Chain 195 and cross shaft 198 are thus employed to limit downward pivotal movement of arms 180 and accurately control the distance between payout rollers 178 and table 30.

It will be appreciated that limiting pivotal movement of arms 180 is particularly useful when spreading numerous layers of material for maintenance of the proper payout height with respect to the uppermost layer of material. The wheels 182 function to raise arms 180 and rollers 178 over catcher assemblies 32 as will be more fully described hereinafter. Preferably, motor 190 is controlled by the microprocessor on board carriage 28 to reduce downmost pivotal movement of arms 180 in predetermined increments after each spreading of a preselected number of layers of material. This feature also provides a means by which compensation can be made for various material thicknesses.

Referring now to FIG. 5, there is shown monitor 200 which is utilized to coordinate movement of carriage 28 relative to the material carried and fed thereby. Monitor 200 includes a lamp 202 which projects a beam of light through an aperture and across scray 172. Photosensor arrays 204 and 206 are positioned opposite lamp 202 behind apertures on the other side of scray 172. Photosensor arrays 204 and 206 are functionally independent, each comprising a plurality of photosensors arranged vertically so as to sense the height of loop 174 as the fabric is being advanced through scray 172.

In one embodiment of the invention, photosensors 208, 210, 212 and 214 comprise photosensor array 204, to which feed roller 157 is responsive. Photosensors 216, 218 and 220 comprise photosensor array 206, to which hydrostatic drive motor 148 shown in FIG. 4 is responsive. Depending upon the size and response of motor 148 of carriage 28, it may be desirable to disconnect photosensor array 206 from operation. It will be apparent that a variance in the relative rates of input and output will cause the material in loop 174 to hang at changing levels. For example, loop 174 hangs at a relatively lower level when feed roller 157 advances material into scray 172 at a rate faster than payout of the material during travel of carriage 28. Conversely, loop 174 hangs at a relatively higher level as shown in phantom lines in FIG. 5 when the material is being paid out by carriage 28 at a rate relatively greater than the feed rate from bolt 18. The beam interruption detected by the photosensors is utilized by a microprocessor controller located in cabinet 159 shown in FIG. 4 to generate appropriate speed signals for feed roller 157 and hydrostatic drive motor 148.

Monitor 200 includes two other photosensors which are used in conjunction with the material feed. Lamp/-photosensor 222 is located at the bottom of scray 172 and detects a scray full condition. When excess material is fed into scray 172, as shown in phantom lines, the beam of lamp/photosensor 222 is broken to generate a signal deactuating feed roller 157. This allows the output to catch up with the input. Lamp 224 projects a beam across the material path between bolt 18 and feed roller 157 onto an opposing photodetector 226. The beam of lamp 224 is broken as long as material is being fed from bolt 18. Thus, upon the nonoccurrence of beam reception by photodetector 226, a reload signal is generated for use by the microprocessor in commanding carriage 28 to park beneath elevator assembly 26.

It will be understood that the ability of monitor 200 to continuously coordinate the actual material feed rate with the actual spreading rate, which corresponds to the rate of travel of carriage 28, comprises a significant feature of the present invention. By this means the rate of acceleration as well as the rate of speed of carriage 28 is specifically matched to the rate at which material can be drawn off bolt 18 by feed roller 157. As a result, superior performance of system 10 is achieved. Between catcher assemblies 32 the material is spread over table 30 at the maximum rate at which it can be drawn from bolt 18 by feed roller 157. Monitor 200 automatically compensates for specific feeding difficulties with bolts 18 of various sizes and fabrics of different grades and further compensates for the change in mass and rotational inertia of bolt 18 during the feeding and spreading operation. Sudden changes in the rate of feeding or spreading of the material which could cause tension, breakage or other damage therein are eliminated. Moreover, the uncontrolled payout of material is prevented when the carriage 28 comes to a halt and reverses direction over catcher assemblies 32.

In accordance with the preferred construction of the invention, lamp/photosensor 222 performs a dual function. In addition to detecting excess material in the scray 172, lamp/photosensor 222 can also be employed to determine whether the material was in fact caught by one of the catcher assemblies 32 upon turnaround. If for some reason the material is not properly engaged and caught by one of the catcher assemblies 32, the material will trail behind carriage 28 until sufficient friction develops with the previous layer of spread material to draw the material from scray 172 and down between payout rollers 178. Each miss of a catcher assembly 32 thus causes two short layers of material to be spread, which results in material waste. To prevent this occurrence, the microprocessor on board carriage 28 can be programmed to scan lamp/photosensor 222 after each turnaround of the carriage. A beam interruption of the lamp/photosensor 222 at that time would serve as an early indicator that no hookup occurred so that the spreading operation can be interrupted to cure the condition early on. In actual practice scanning of lamp/-photosensor 222 occurs at a distance of approximately ten feet away from each catcher assembly 32 as carriage 28 is moving away.

Figure 8:
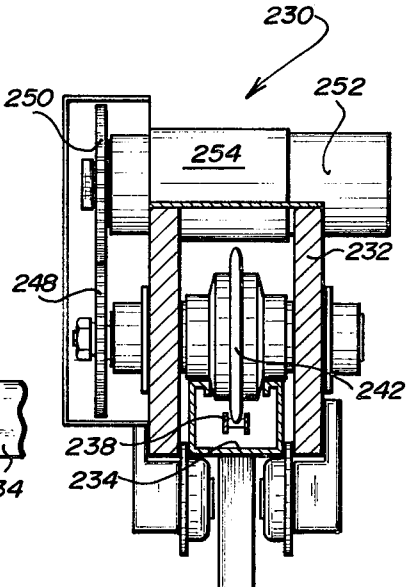
FIGS. 7 and 8 are vertical section views taken, respectively, along lines 7—7 and 8—8 of FIG. 6 in the direction of the arrows.
Figure 6:
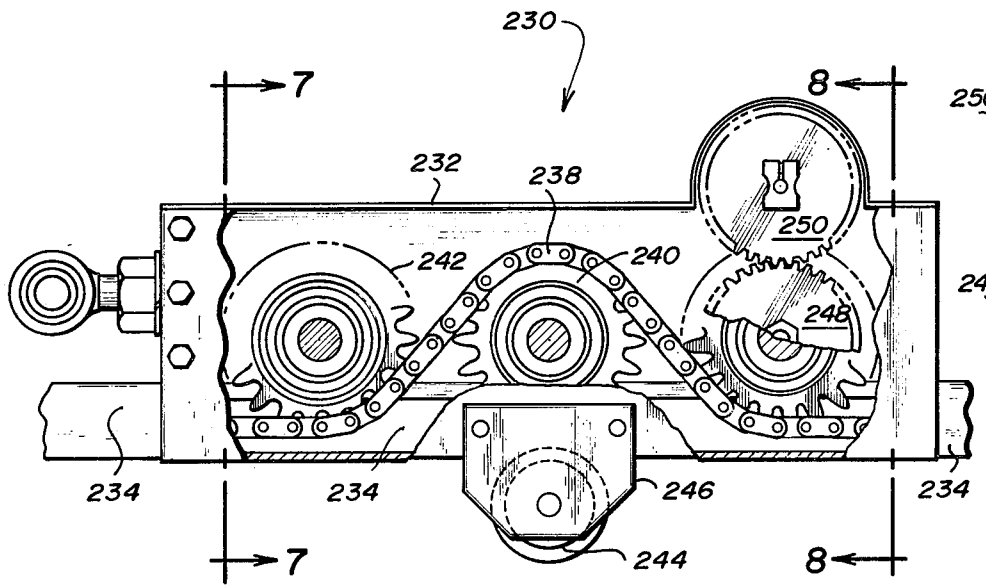
FIG. 6 is a side view of the positional feedback assembly portion of the invention in which certain parts have been broken away to illustrate more clearly certain features of the invention.
Figure 7:
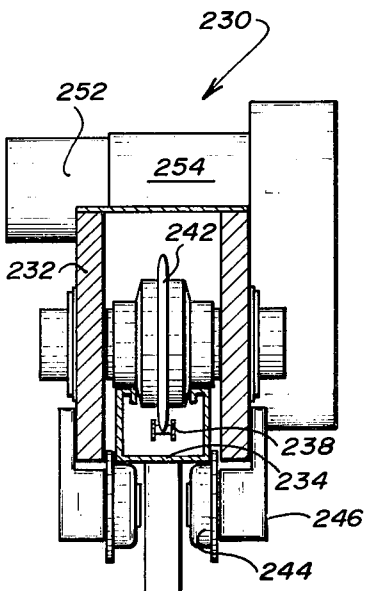

Referring now to FIGS. 6, 7 and 8 in conjunction with FIG. 4, there is shown the positional feedback assembly 230 which generates reference signals corresponding to the location of carriage 28 anywhere along table 30. Assembly 230 includes a trolley 232 slidably carried on fixed channel 234. Link 236 connects trolley 232 to movable carriage 28, while channel 234 and chain 238 positioned therein are fixedly secured to and extend the entire length of table 30. Preferably, at least one end of chain 238 is adjustably secured so that chain 238 can be directed over center sprocket 240 and under end sprockets 242, which are rotatably supported within trolley 232. A pair of rollers 244 mounted for rotation on brackets 246 attached to trolley 232 engage the underside of channel 234 as trolley 232 is guided therealong during travel of carriage 28. Gear 248 secured to the shaft of one of end sprockets 242 is enmeshed with antibacklash gear 250 to which potentiometer 252 is connected through speed reducer 254.

It will thus be appreciated that during translation of carriage 28 potentiometer 252 is caused to rotate in accordance therewith. The signal generated by the rotation of potentiometer 252 is employed by the microprocessor controller located in cabinet 159 seen in FIG. 4 to continually sense the position of carriage 28 along table 30. In accordance with the preferred construction, potentiometer 252 comprises a ten turn precision potentiometer turning through suitable reduction gearing to convert a full 193 foot table length to ten turns of the potentiometer. This has enabled positional detection of carriage 28 along table 30 to within ⅛ inch, which has been found satisfactory in actual practice. Consequently, it will be understood that feedback assembly 230 provides a means for continually sensing the address of carriage 28 along table 30 so that appropriate commands can be generated.

Figure 9:
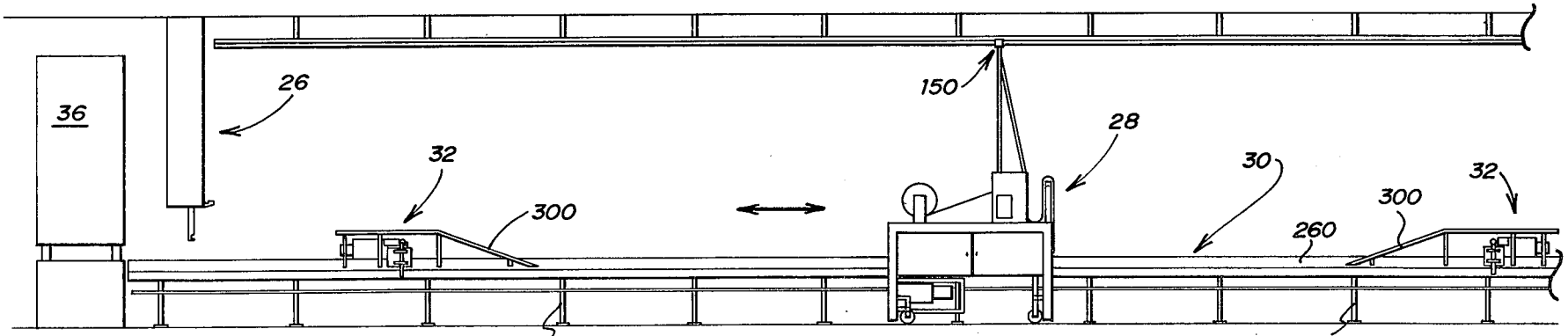
FIG. 9 is a partial side view of the spreading portion of the inventive embodiment shown in FIG. 1.

With reference to FIGS. 5 and 9, after loading and threading of carriage assembly 28, the material from bolt 28 is then spread over table 30 between catcher assemblies 32. Carriage 28 is guided by stationary rail 256 extending adjacent table 30 and by a pair of rollers 258 attached to carriage 28, which are best shown in FIG. 4. Table 30 includes a pair of spaced, vertical side members 260 supported by legs 262. Table 30 can be of any desired length. In accordance with the preferred construction, table 30 includes conveyor 264 mounted for rotation around a course between members 260. The top of table 30 is comprised of slats 266 extending between side members 260 on flanges 268. Spacers (not shown) can be mounted on flanges 268 to separate slats 266, if desired. In actual practice a table 30 with wooden slats 266 has been found satisfactory. Consequently, it will be understood that table 30 can include a false top having a plurality of removable slats 266 over which the material can be spread. Serial removal and replacement of slats 266 positions previously spread layers of material 272 onto conveyor 264 as shown in FIG. 5. This permits advancement of spread material 272 into subsequent work station 36 during spreading of the next layers of material over table 30.

Figure 10:
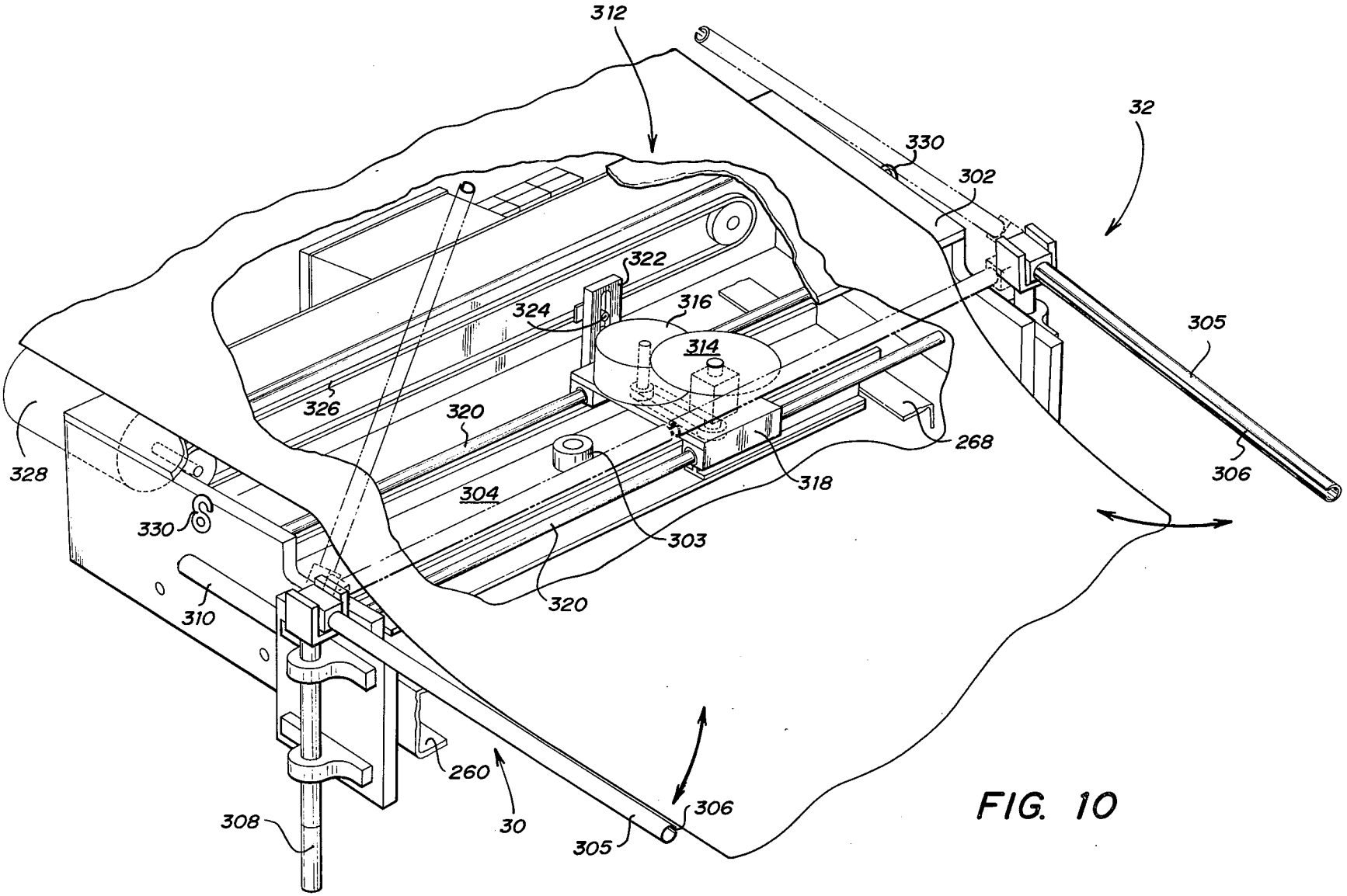
FIG. 10 is a perspective illustration of the catcher assembly portion of the invention in which certain parts have been broken away to illustrate more clearly certain features of the invention.

Having reference to FIGS. 9 and 10, there are shown the catcher assemblies 32. Two catcher assemblies 32 are mounted on table 30 in spaced relationship to define the material spread length therebetween. While two catcher assemblies 32 are employed in the preferred embodiment of system 10, it will be understood that material can be spread over table 30 without the benefit of catcher assemblies. The function of catcher assemblies 32 is to capture and subsequently sever the loops of material formed with each reversal of carriage 28. If desired, however, prevention of the material from trailing behind carriage 28 with each turnaround can be accomplished manually or by simple frictional resistance.

As is best shown in FIG. 9, a pair of rails 300 are secured to table 30 in longitudinal relationship alongside each catcher assembly 32. Each pair of rails 300 includes inclined portions facing the approach direction of carriage 28. The purpose of rails 300 is to engage and guide a portion of carriage 28. As carriage 28 approaches a catcher assembly 32, wheels 182 carried at the distal end of bars 180, which are best shown in FIG. 5, engage and ride upon rails 300 so that the material is laid over the catcher assembly 32 as shown in FIG. 10.

Each catcher assembly 32 includes a housing 302 secured to table 30. For clarity, rails 300 and most of table 30 have been omitted from FIG. 10. Preferably, each catcher assembly 32 is partially supported by pivot bearing 303 resting on cross channel 304 extending between the vertical side members 260. Two catcher bars 305 are pivotally secured to housing 302. Each catcher bar 305 is of substantially tubular construction and includes a slot 306 extending therealong. Catcher bars 305 are mounted for pivotal movement about both the horizontal and vertical axes for selective placement across table 30. Double acting cylinders 308 are coupled to the outside ends of bars 305 for upward and downward pivotal actuation thereof about the horizontal axis. Cylinders 310 are each coupled to the outside ends of catcher bars 305 for inward and outward pivotal actuation thereof about the vertical axis.

As carriage 28 approaches a catcher assembly 32, catcher bars 305 are oriented outwardly and substantially parallel with table 30 as shown in full lines in FIG. 10 to receive the spread material therebetween. After the material has been laid over catcher assembly 32, bars 305 are pivotally actuated inwardly over and across the material to the substantially aligned positions shown in phantom lines in FIG. 10. A loop of material is formed around catcher bars 305 as carriage 28 reverses direction to spread another layer of material. Pivot bearings 303 permit the catcher assemblies 32 to float slightly so that the loop of material is uniformly engaged across the width without undue stress at either edge. It will thus be apparent that catcher bars 305 positively prevent the material from following carriage 28 on successive passes over table 30.

With the material firmly looped about catcher bars 305, cutter 312 is then actuated. Cutter 312 comprises a substantially horizontal rotary blade 314 driven by motor 316 connected thereto. Motor 316 and rotary blade 314 are mounted for lateral movement within catcher assembly 32. In accordance with the preferred construction, motor 316 and blade 314 are secured to platform 318 which is mounted for sliding movement on rods 320 extending between the sides of housing 302.

Bracket 322, which is secured to platform 318, includes a slot in which pin 324 is constrained for vertical movement. Pin 324 in turn is secured to endless belt 326 which is rotatably driven by motor 328 about a lateral course substantially parallel with rods 320. It will be apparent that rotation of belt 326 causes pin 324 to displace platform 318. Rotary blade 314, which registers with slots 306 in bars 305, thus traverses and severs the end loop of material to separate succesive layers of material.

In the preferred embodiment, cutter 312 is actuated after a predetermined time delay. This time delay enables carriage 28 to spread a sufficient length of material whereby the frictional resistance between adjacent layers of material effectively prevents undue misalignment of the ends of successive layers upon severance of each end loop therebetween.

Following separation of each end loop of material, catcher assembly 32 is reset. Catcher bars 305 are first pivotally actuated upwardly to the positions shown in phantom lines in FIG. 10 to clear the material therefrom, after which bars 305 are repositioned in the parallel, ready orientation depicted in full lines. With the cycles of catcher bars 305 and cutter 312 completed, catcher assembly 32 is prepared for the next approach of carriage 28.

It will thus be understood that carriage 28 reciprocates over table 30 between catcher assemblies 32. Carriage 28 reduces speed as it approaches each catcher assembly 32 to lay the material thereover. Catcher bars 305 pivot inwardly to restrain the end loop of material formed when carriage 28 reverses direction. Cutter 312 subsequently severs the end loop of material, after which catcher bars 305 are repositioned. The spreading operation continues with the catcher assemblies 32 functioning alternately in this fashion until all of the material from bolt 18 on carriage 28 is depleted, which event is sensed by restoration of the beam received by photodetector 226 shown in FIG. 5. A reload command is thus generated and carriage 28 positions itself beneath elevator assembly 26 for reloading, which proceeds as was hereinbefore described.

It has been found desirable to provide for selective material spread lengths over table 30. This can be accomplished by providing appropriate connections (not shown) at predetermined stations along table 30 where one catcher assembly 32 can be demountably attached. Hooks 330 shown in FIG. 10 are provided on housing 302 for transporting a catcher assembly 32. Removal and relocation of one of the catcher assemblies 32 can be easily accomplished with carriage 28 if provided with appropriate lifting apparatus. Returning momentarily to FIG. 4, carriage 28 is shown equipped with a retractable lifter 332 and a manual jack 334. When so equipped and operated in a manual mode, it will be appreciated that carriage 28 can be utilized to relocate a demountable catcher assembly 32. For example, catcher assembly 32 could be repositioned on table 30 to provide for material spread lengths from a full table to $\frac{3}{4}$, $\frac{1}{2}$ or $\frac{1}{4}$ of the overall length of table 30.

Conventional encoded plugs (not shown) are provided at each station for demountable catcher assembly 32 to generate appropriate reference signals which are transferred by data transfer devices 336 shown in FIG. 4 to the microprocessor controller located in cabinet 159 on carriage 28. Data Transfer devices transfer comprise electromagnetic switching units 336*a* fixedly mounted at the reload/park position for carriage 28, and units 336*b* mounted on the carriage. In actual practice, four bits of data are transferred to the carriage 28 for use by the microprocessor in controlling system 10, while 1 bit of data is received from the carriage. The particular location signal at the selected station for catcher assembly 32 is utilized by the microprocessor controller (not shown) to generate appropriate slowdown and turnaround commands for carriage 28 as a function of the material spread length. Preferably, whenever the movable catcher assembly 32 is disconnected or relocated, appropriate circuitry generates a signal commanding carriage 28 to reregister with data transfer devices 336 before continuing the spreading operation.

Figure 11:
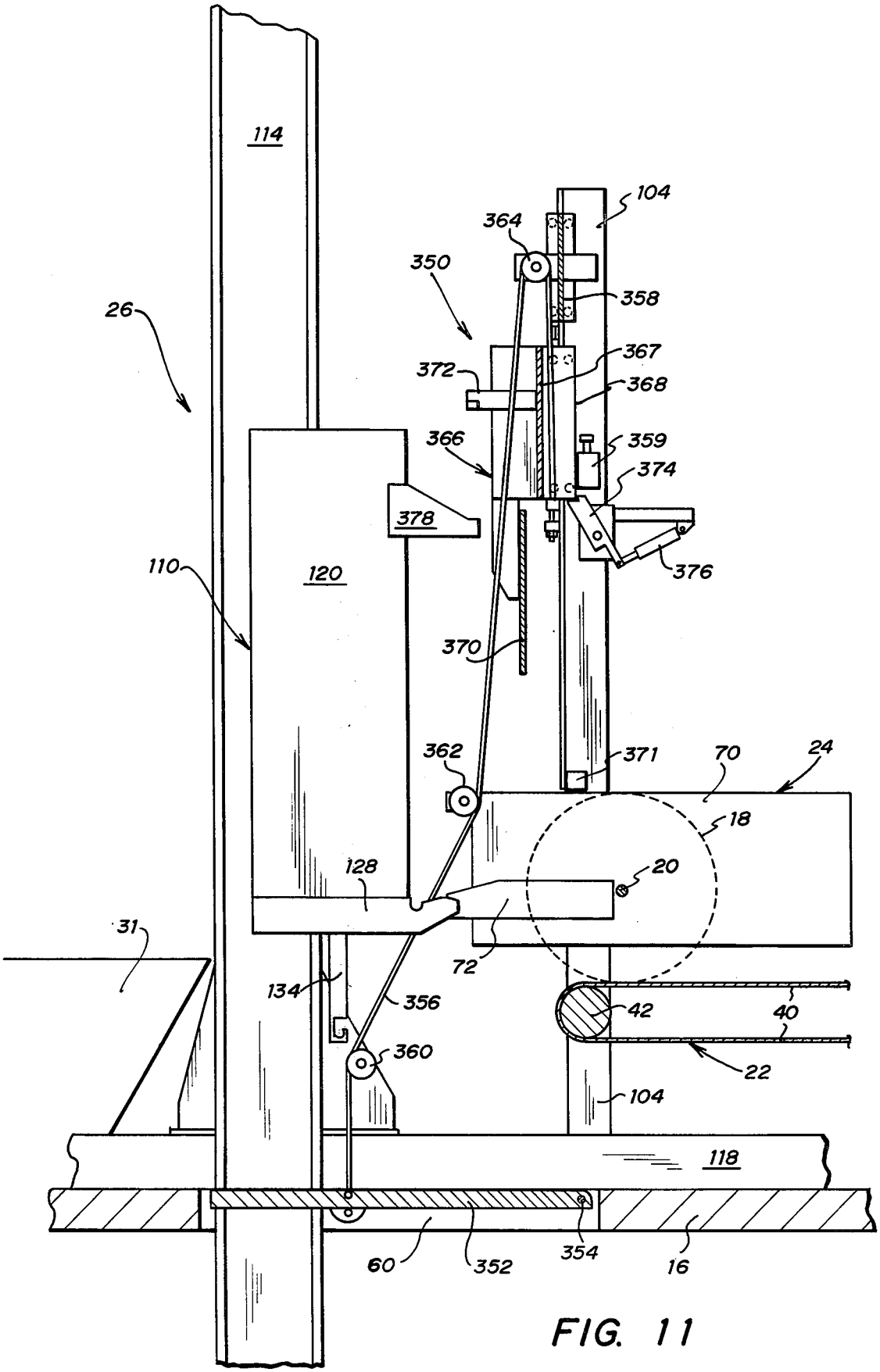
FIGS. 11 and 12 are partial sectional views of a first modification of the storage and loading portion.
Figure 12:
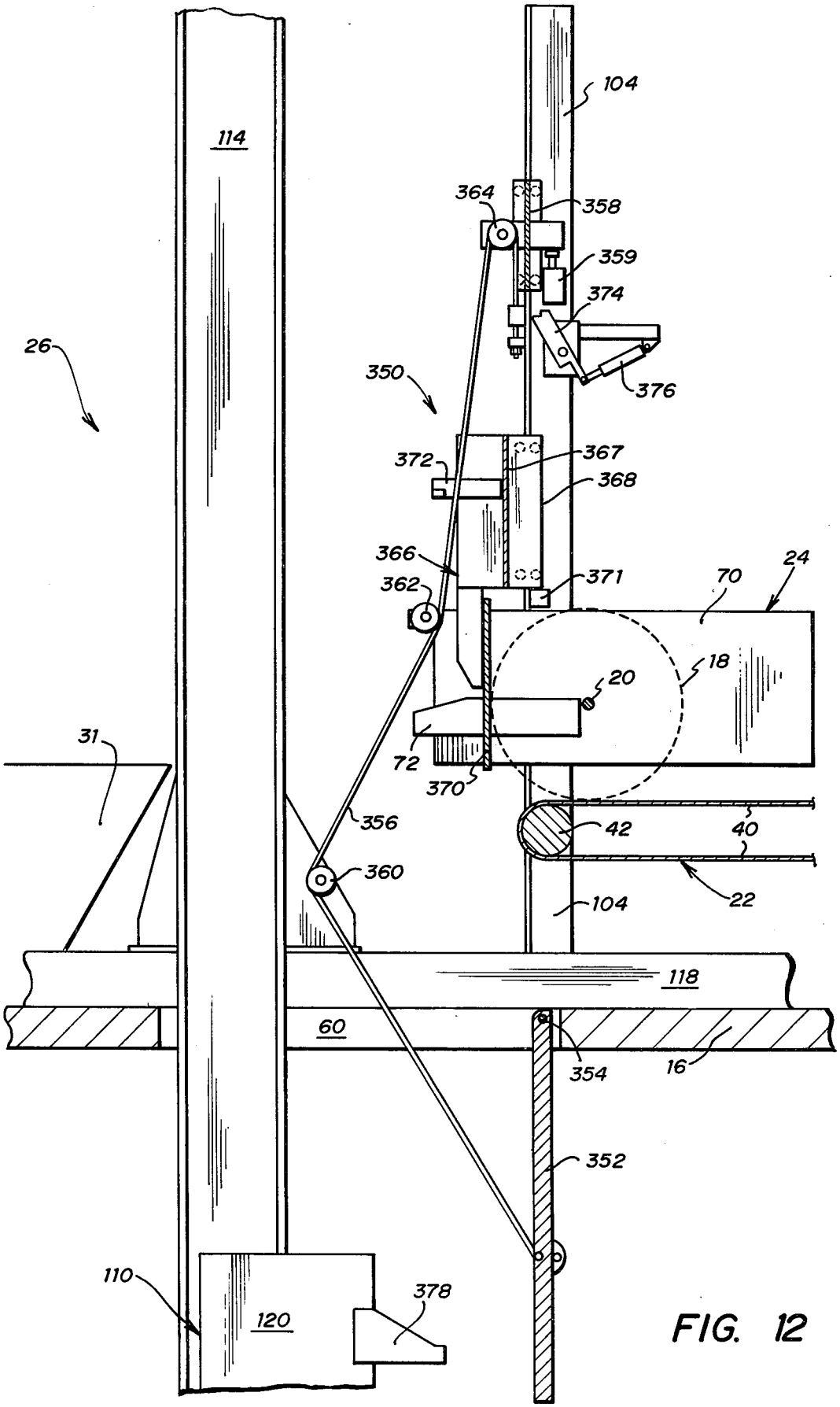
Figure 16:
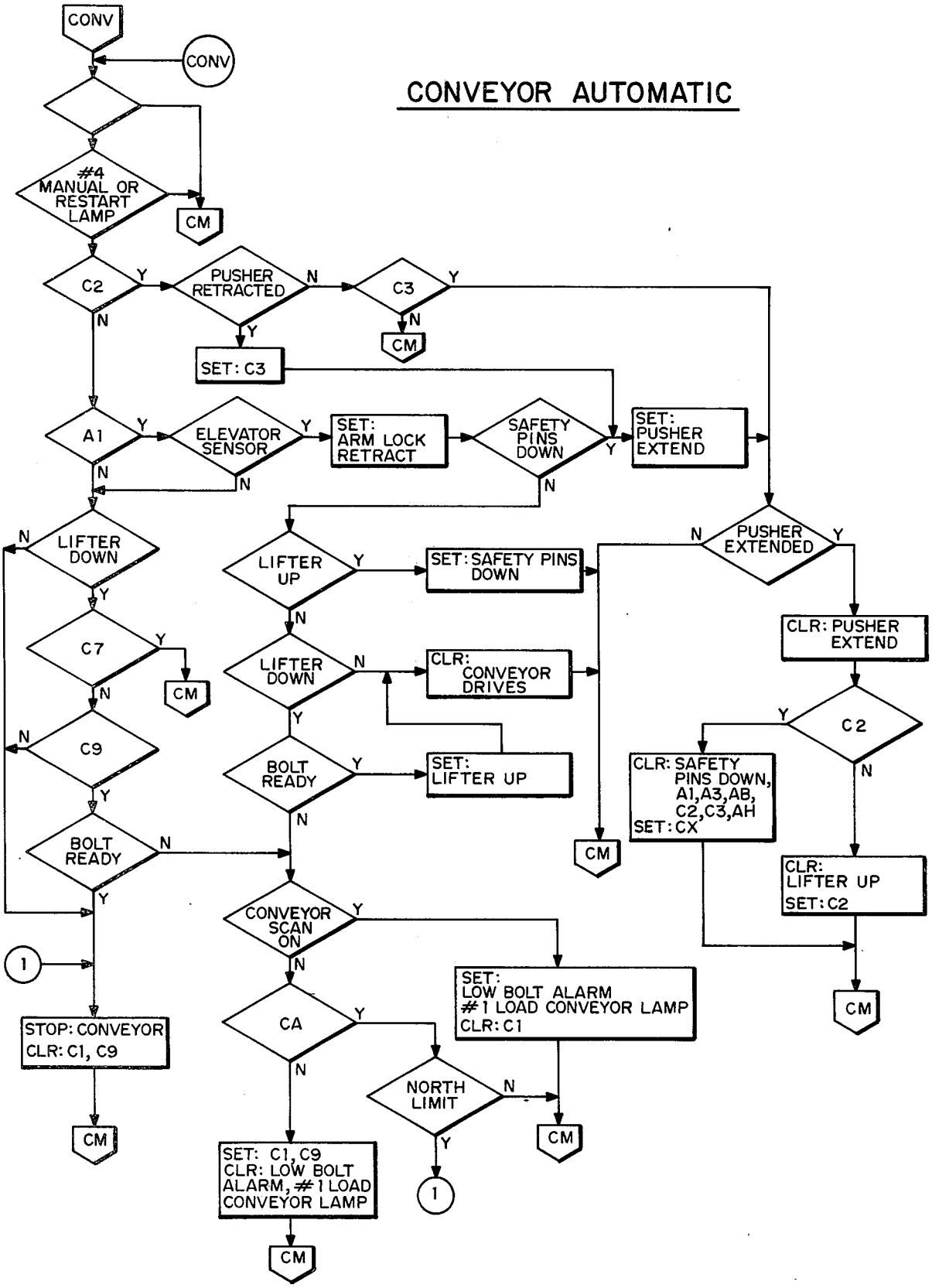
Figure 17:
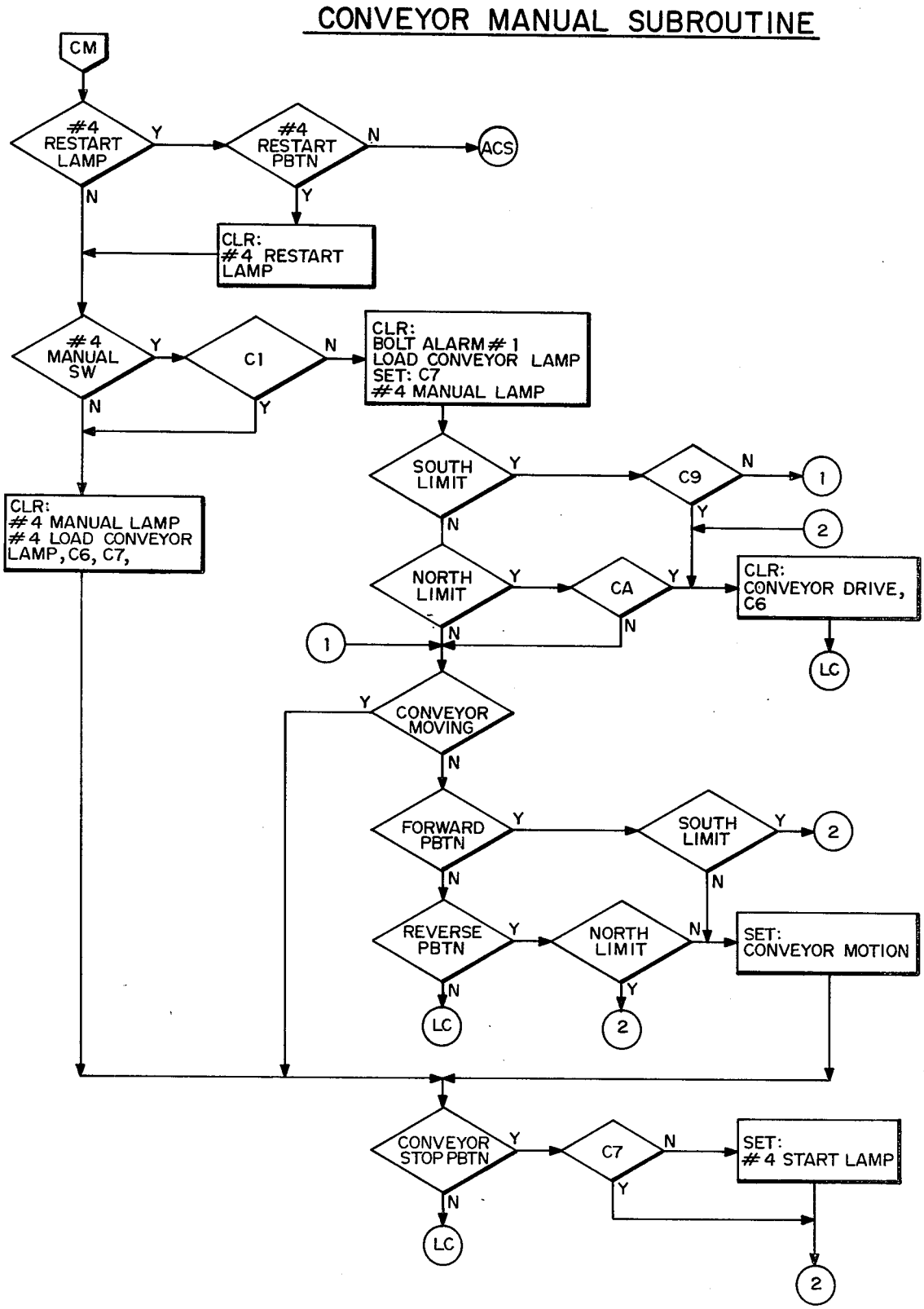
Figure 18:
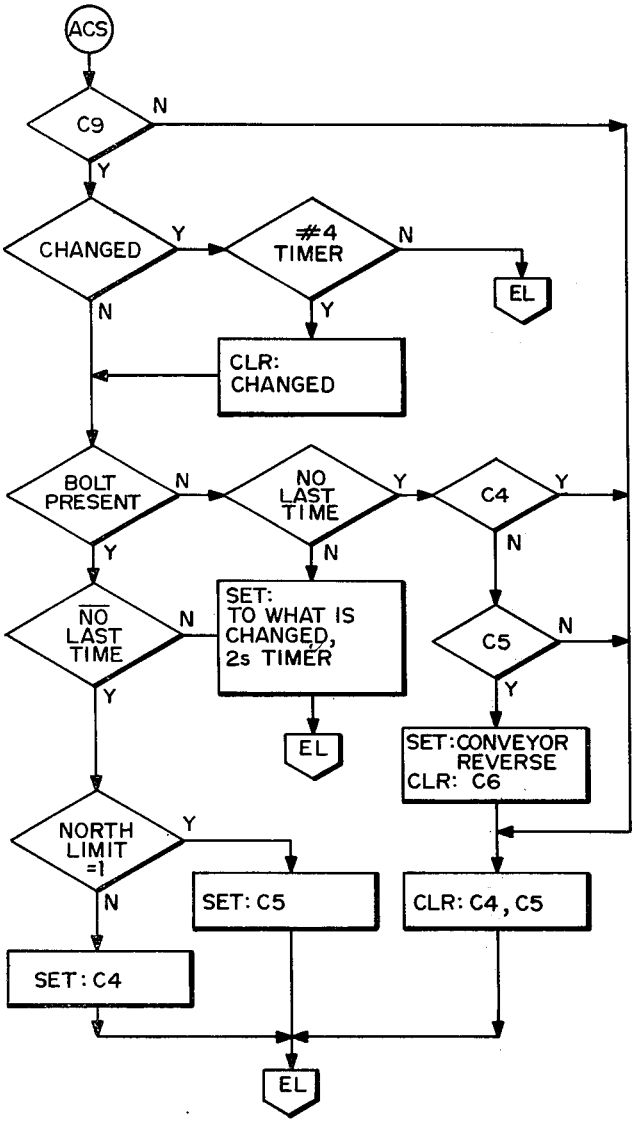
Figure 19:
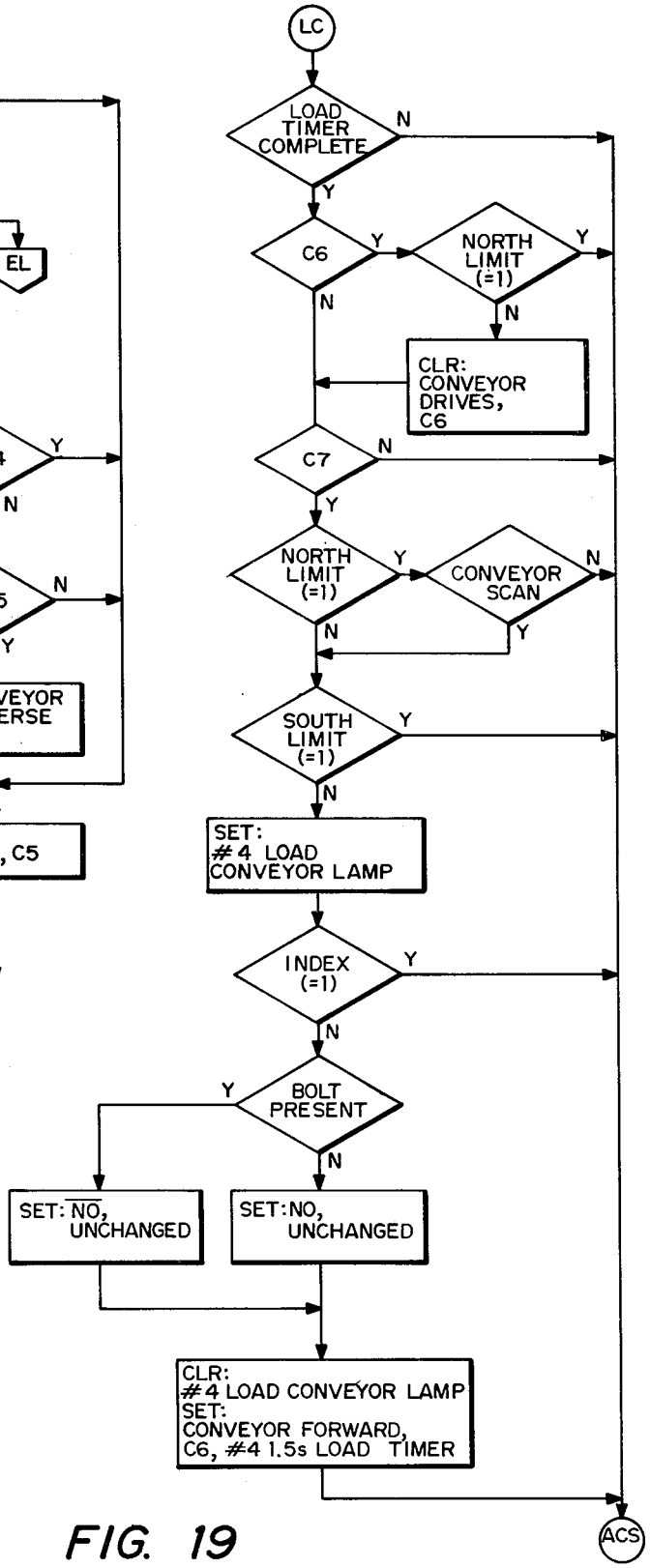
Figure 20:
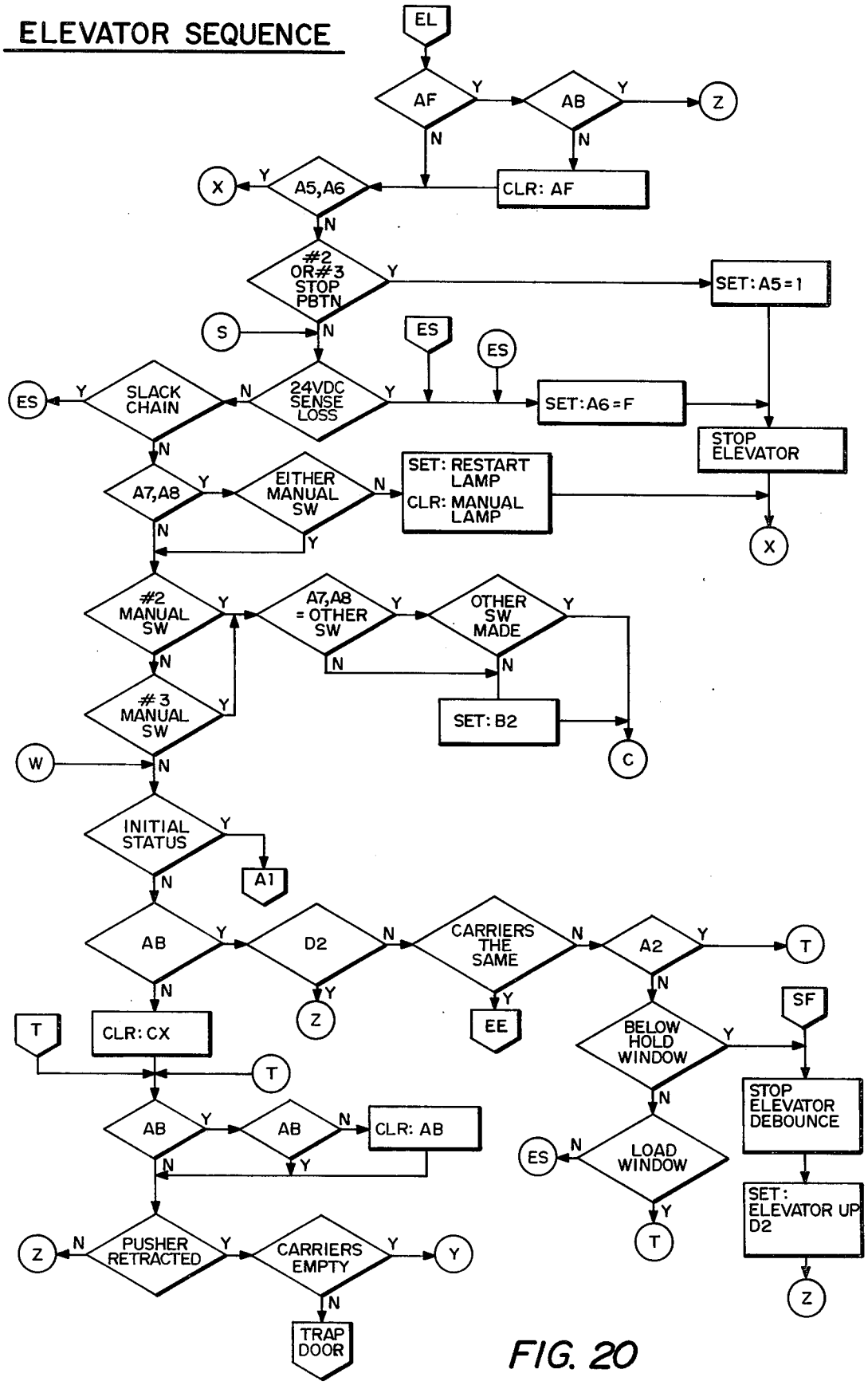
Figure 21:
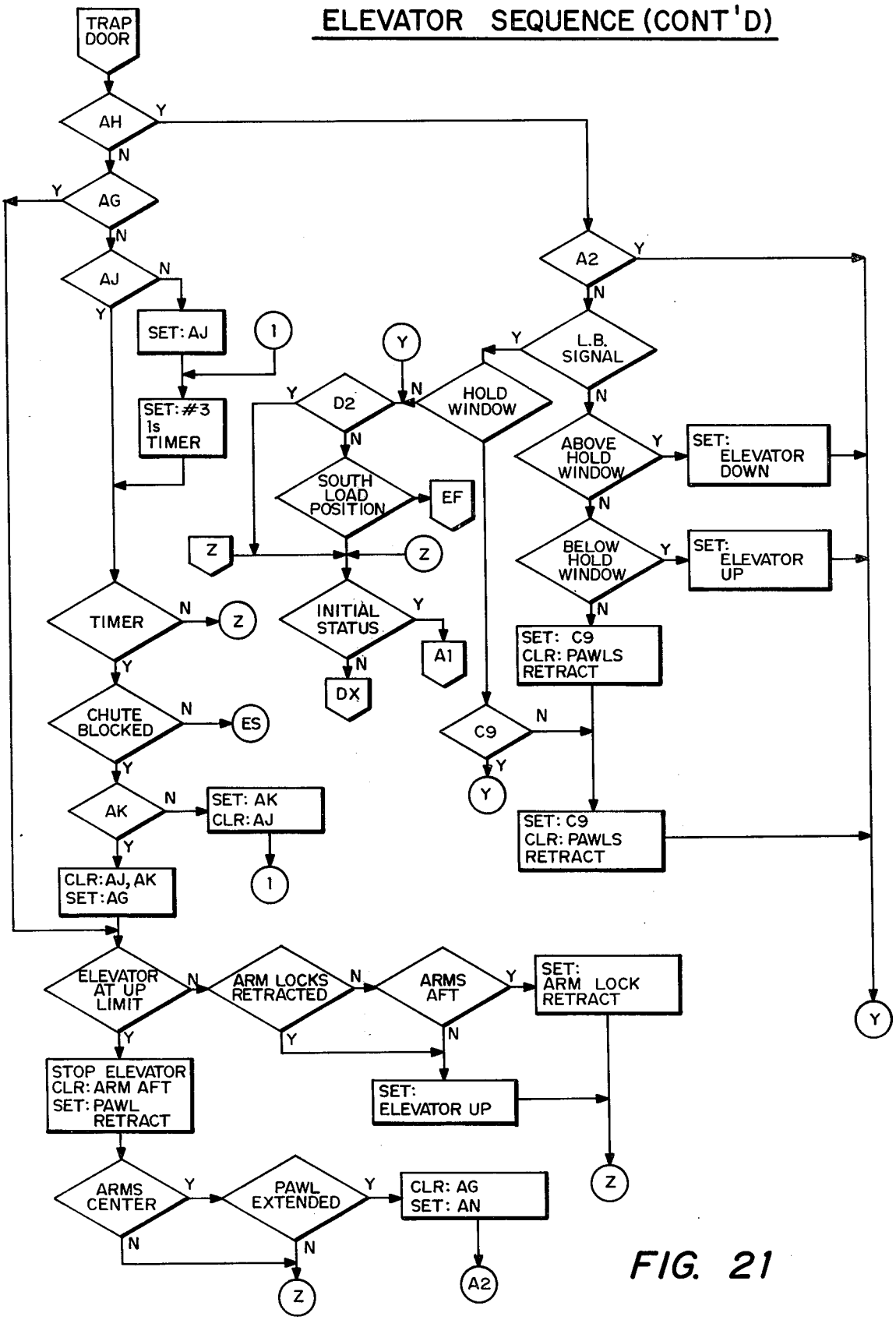
Figure 22:
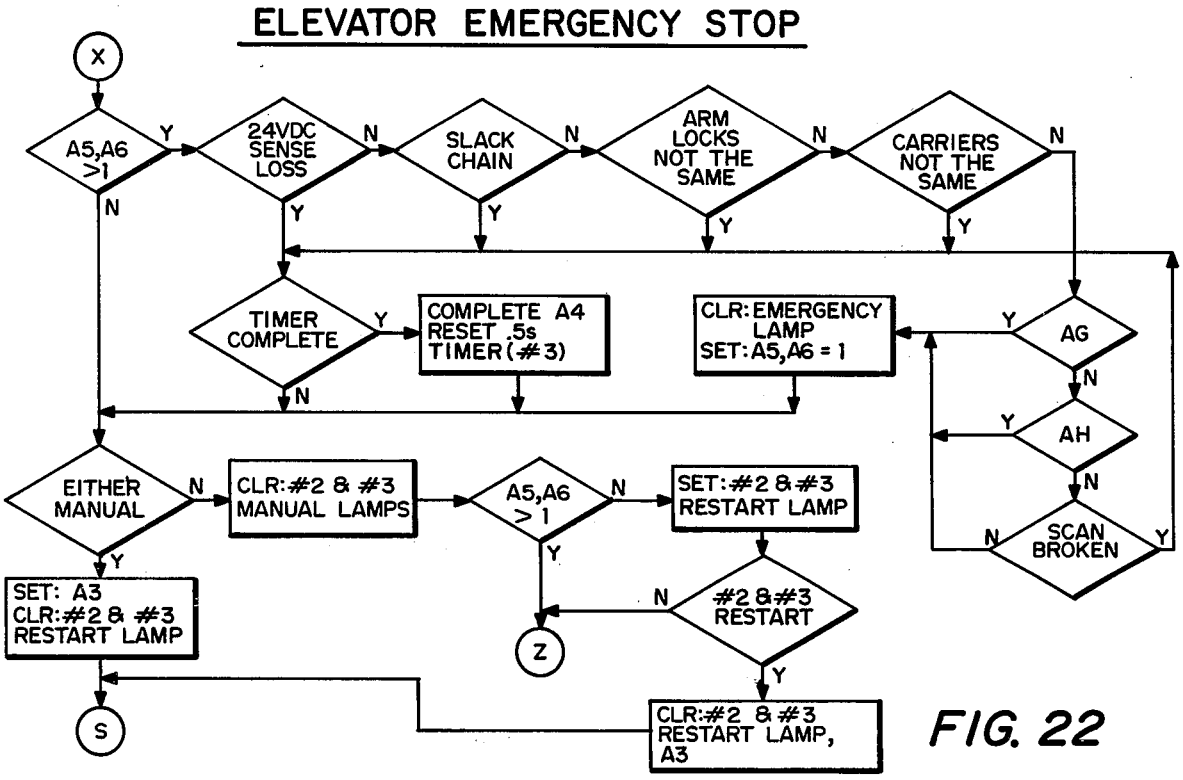
Figure 23:
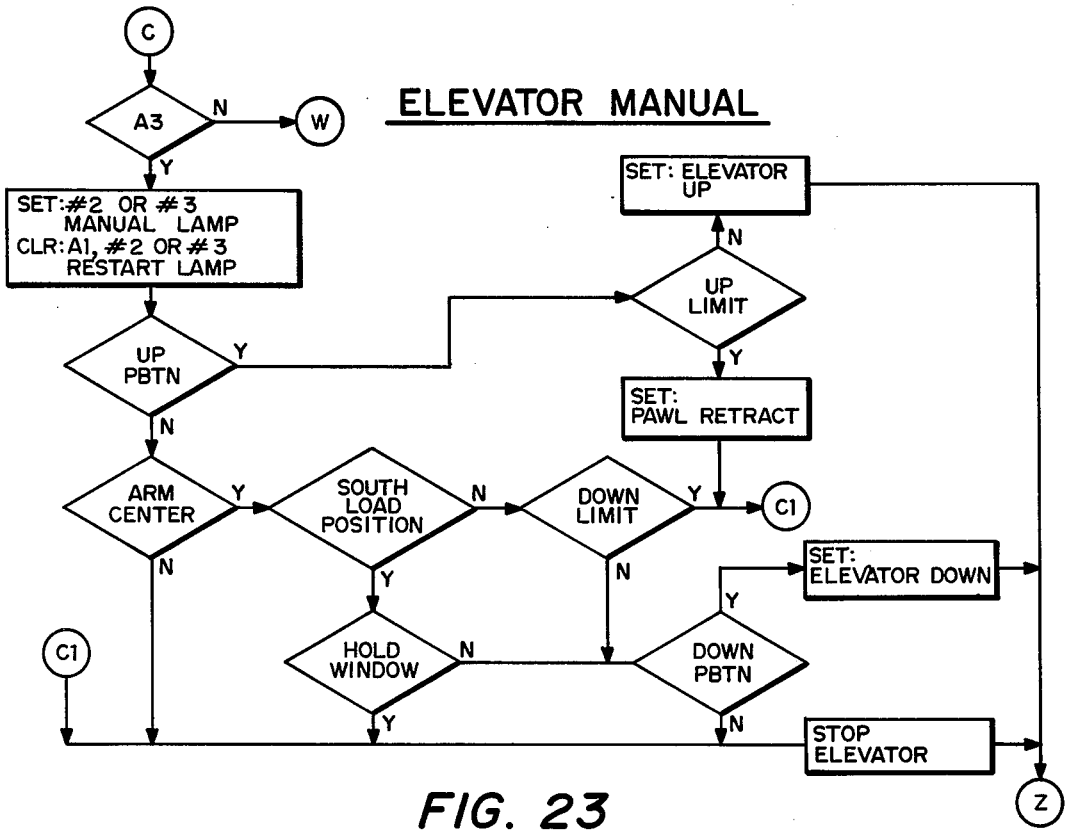
Figure 24:
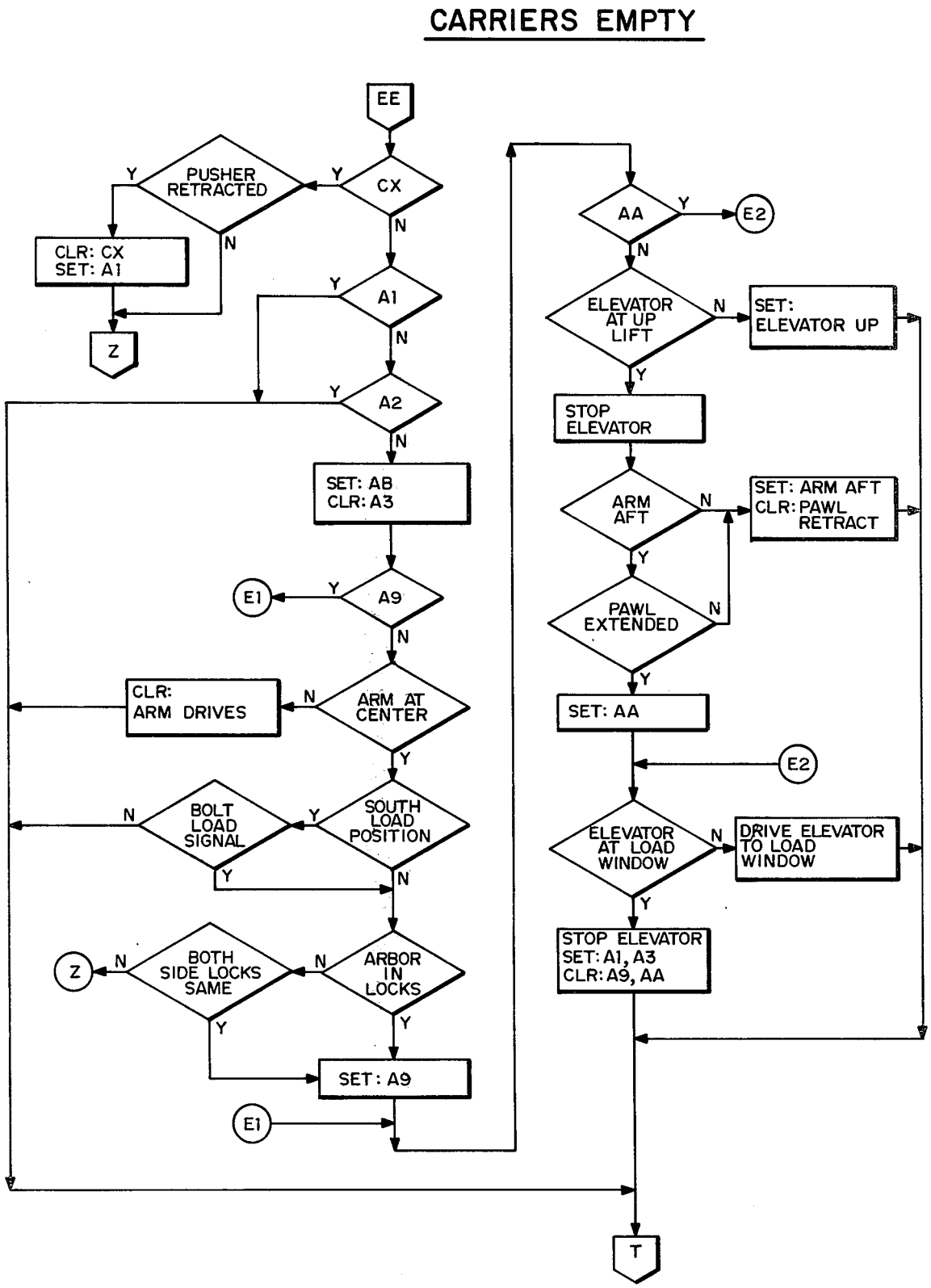
Figure 25:
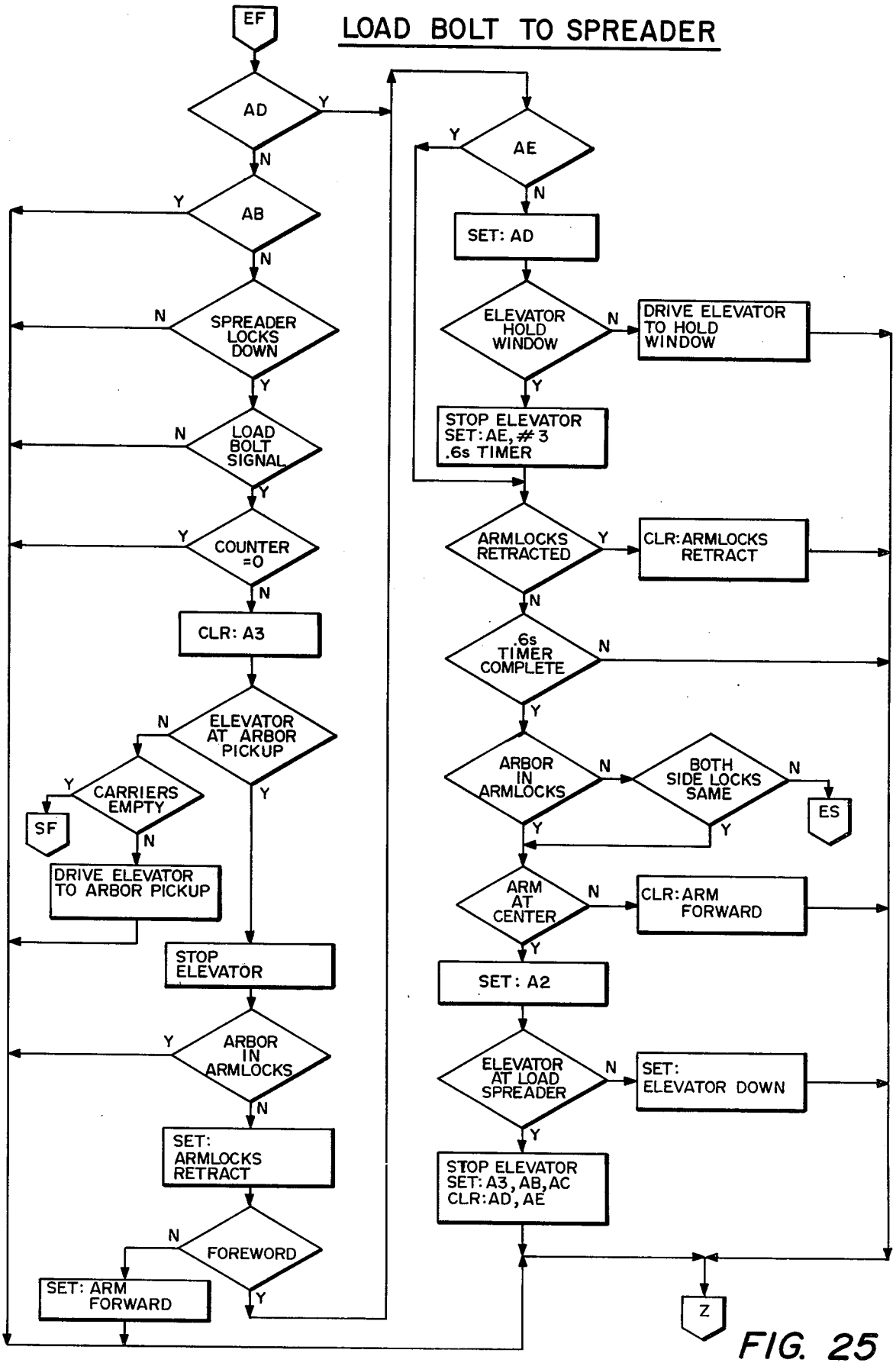
Figure 26:
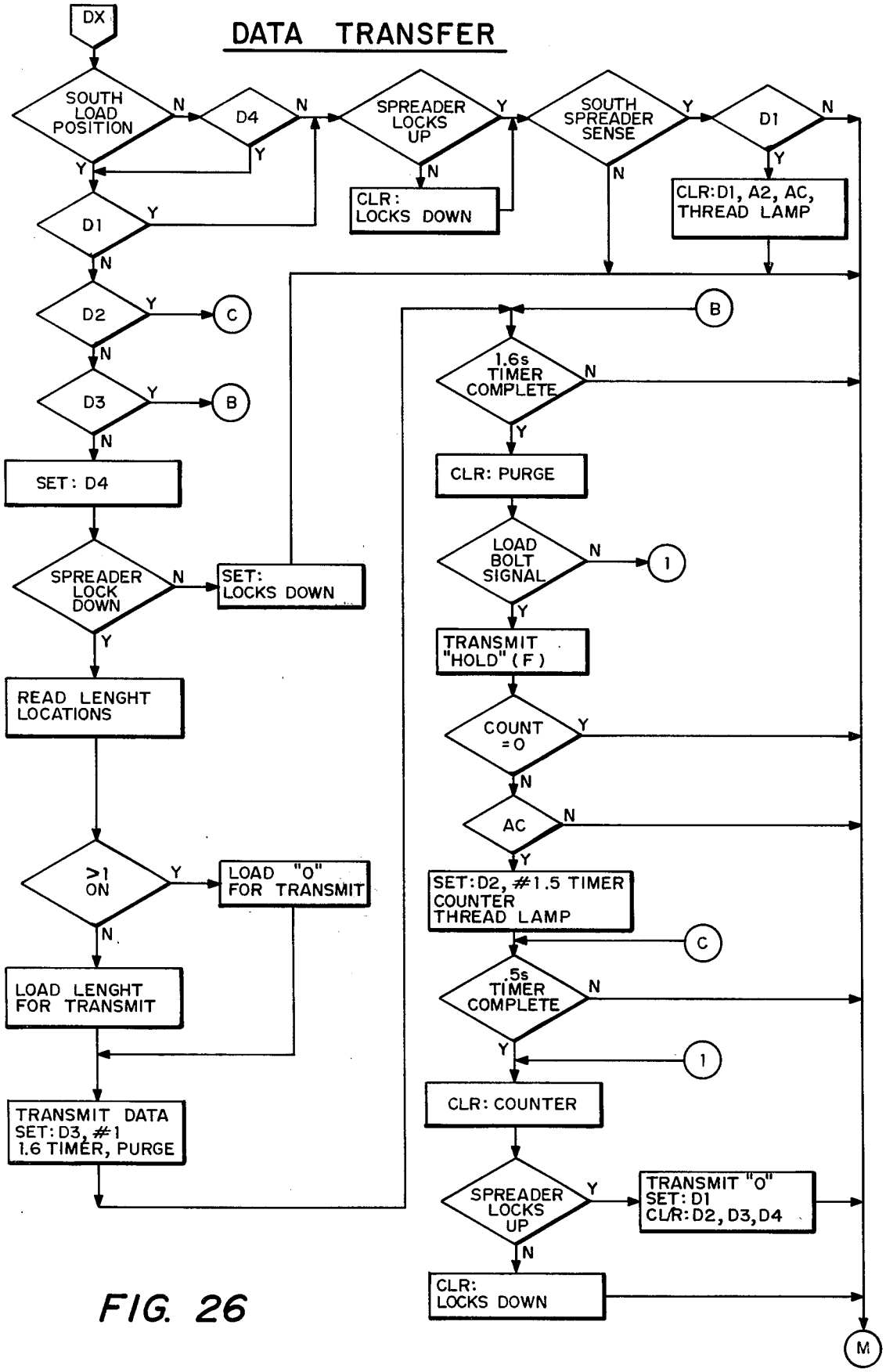
Figure 27:
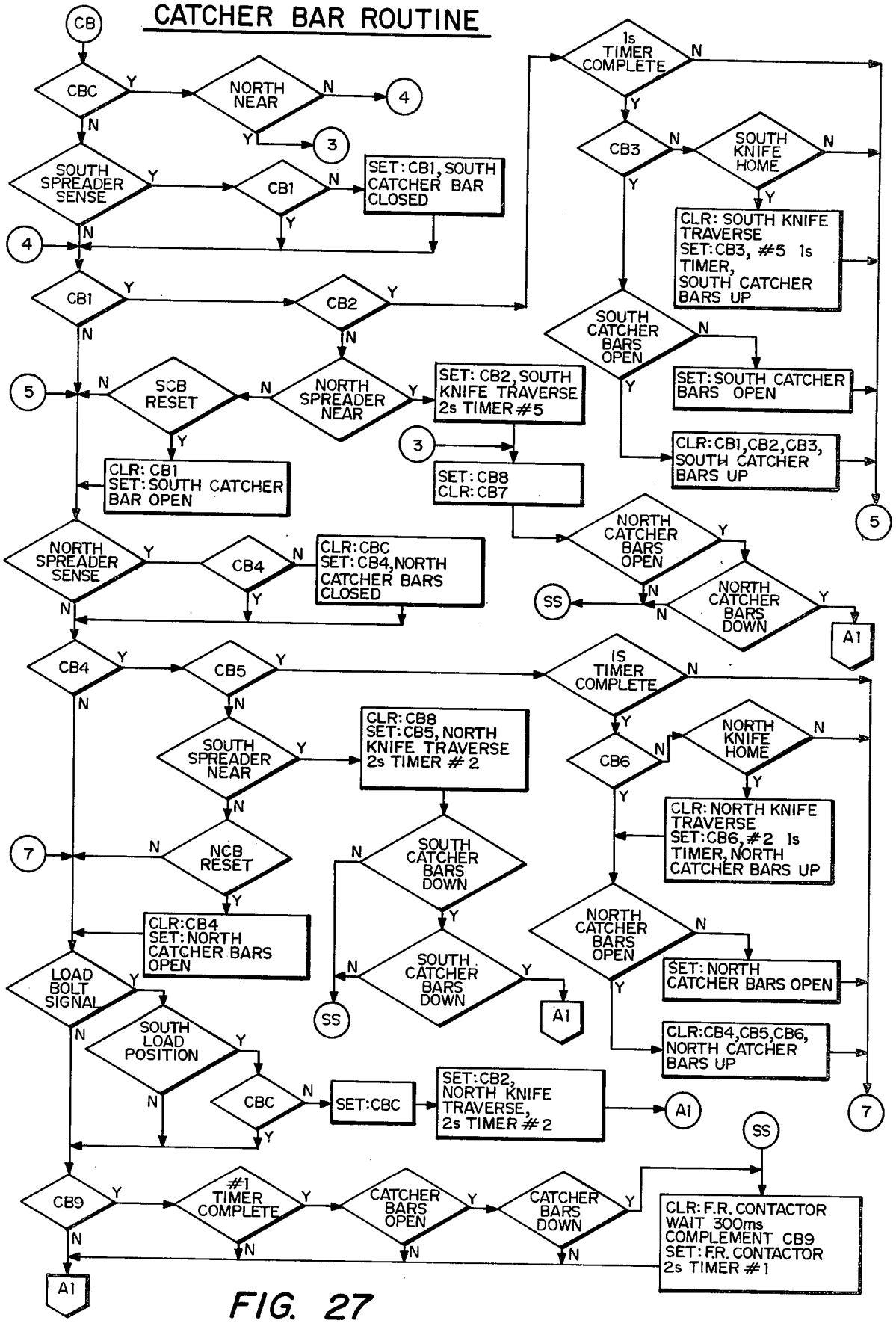
Figure 28:
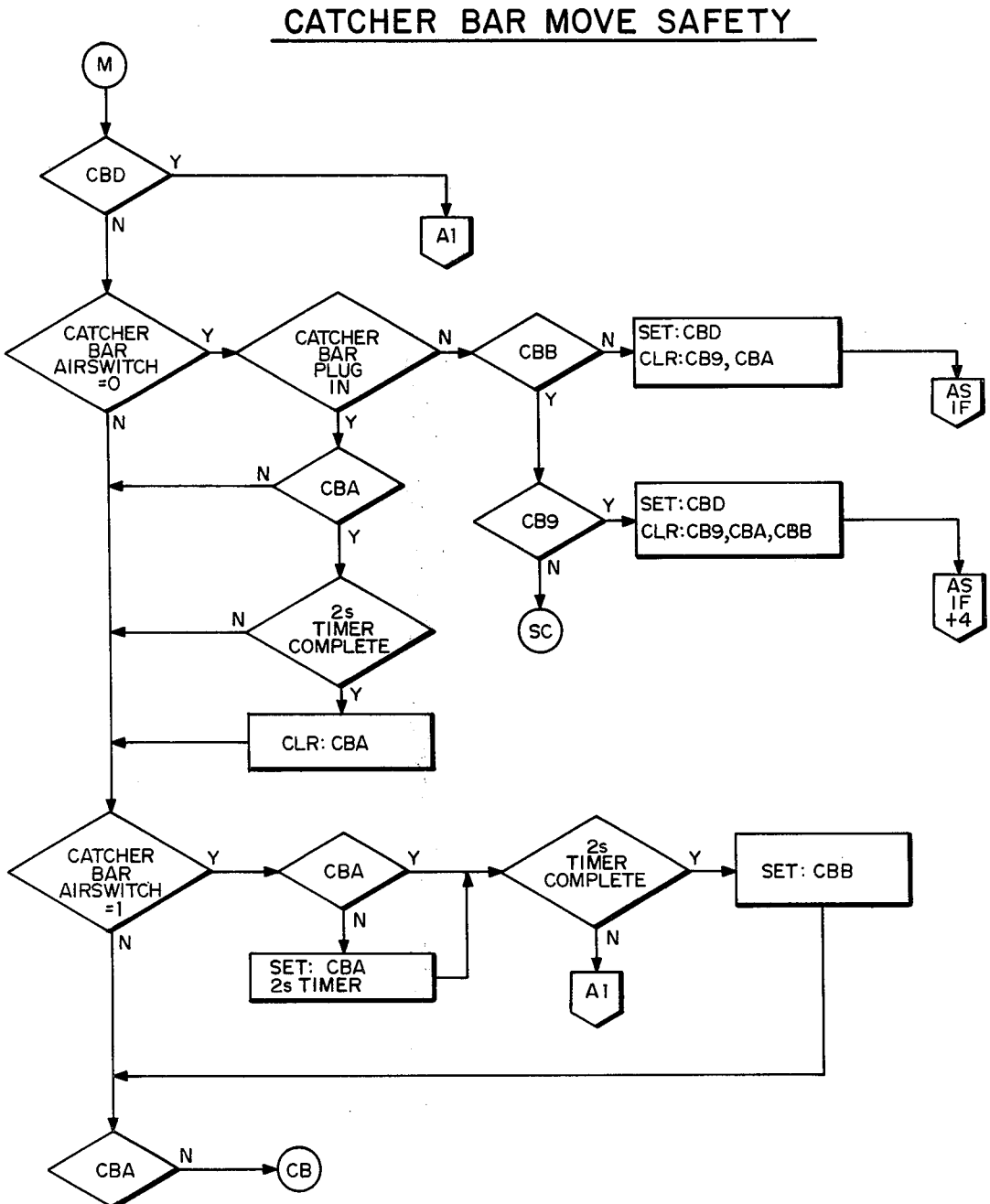
Figure 29:
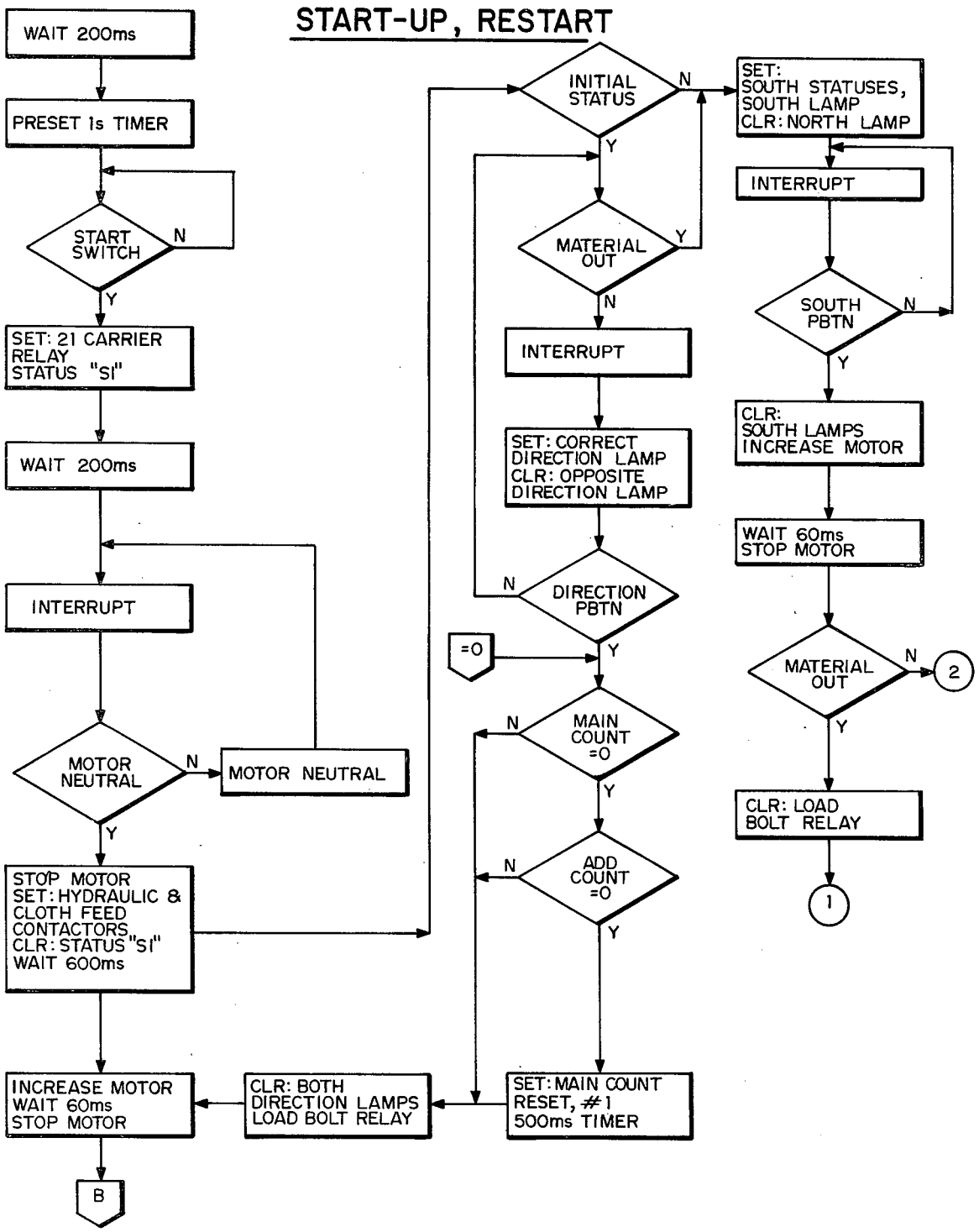
Figure 30:
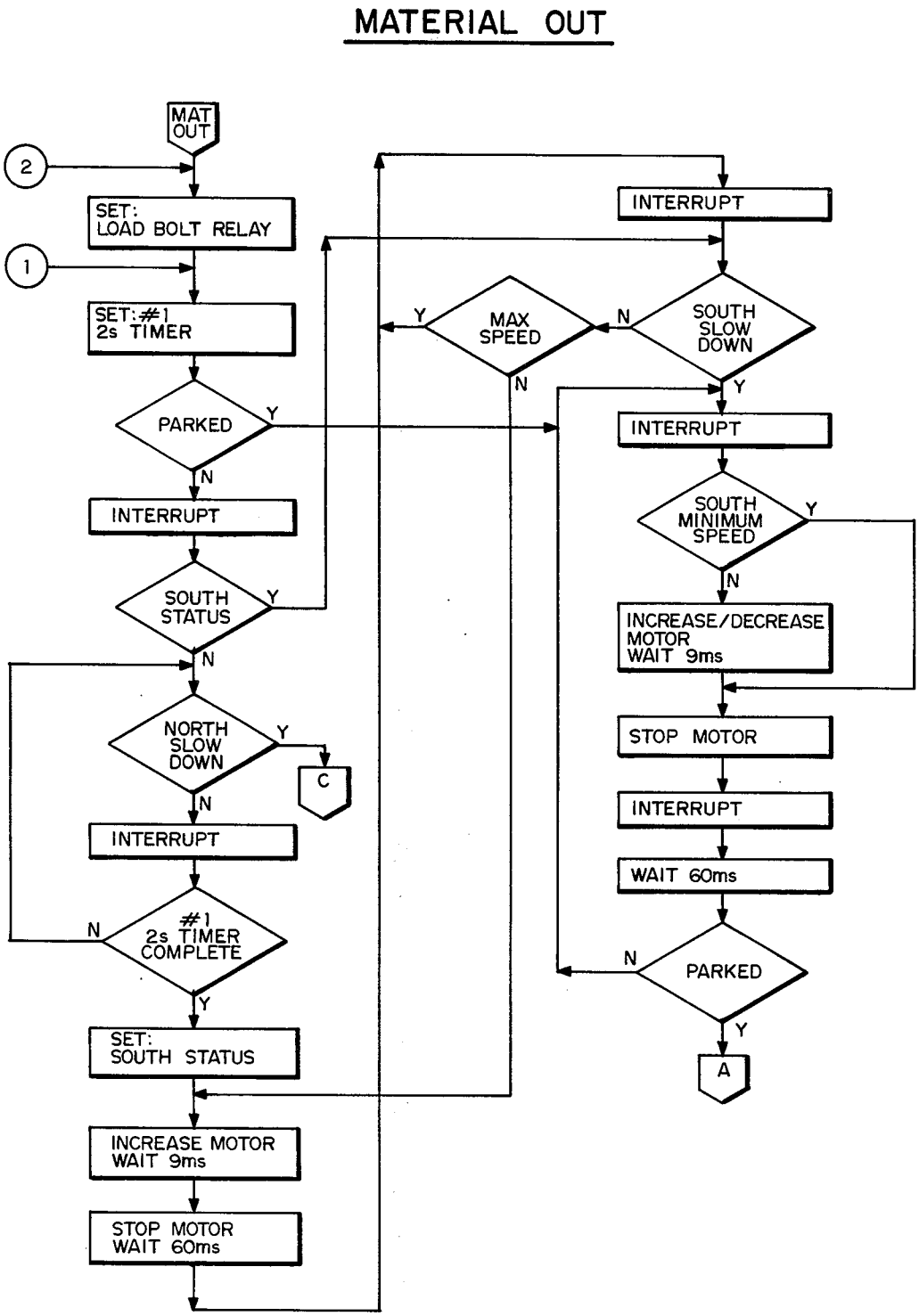
Figure 31:
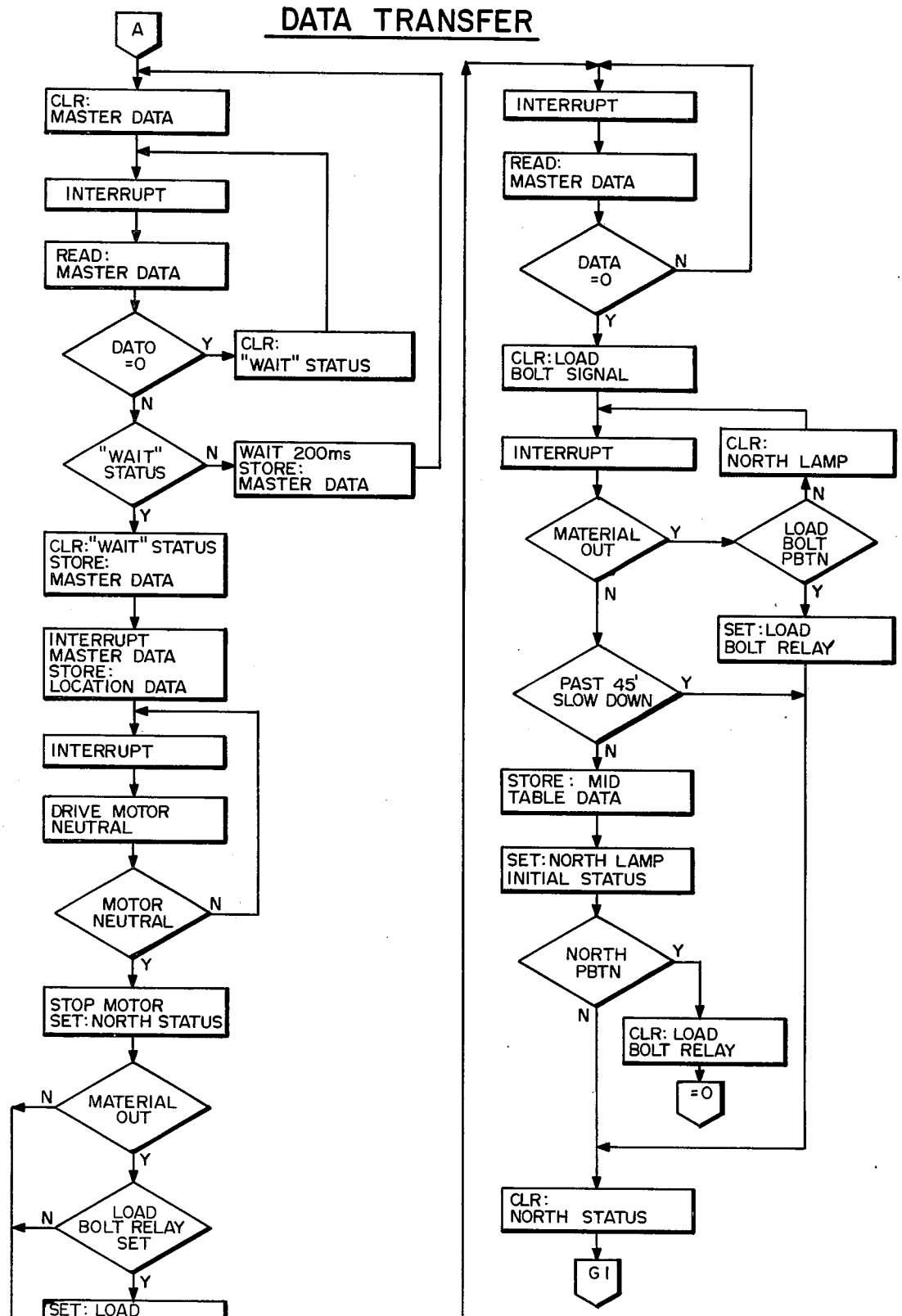
Figure 32:
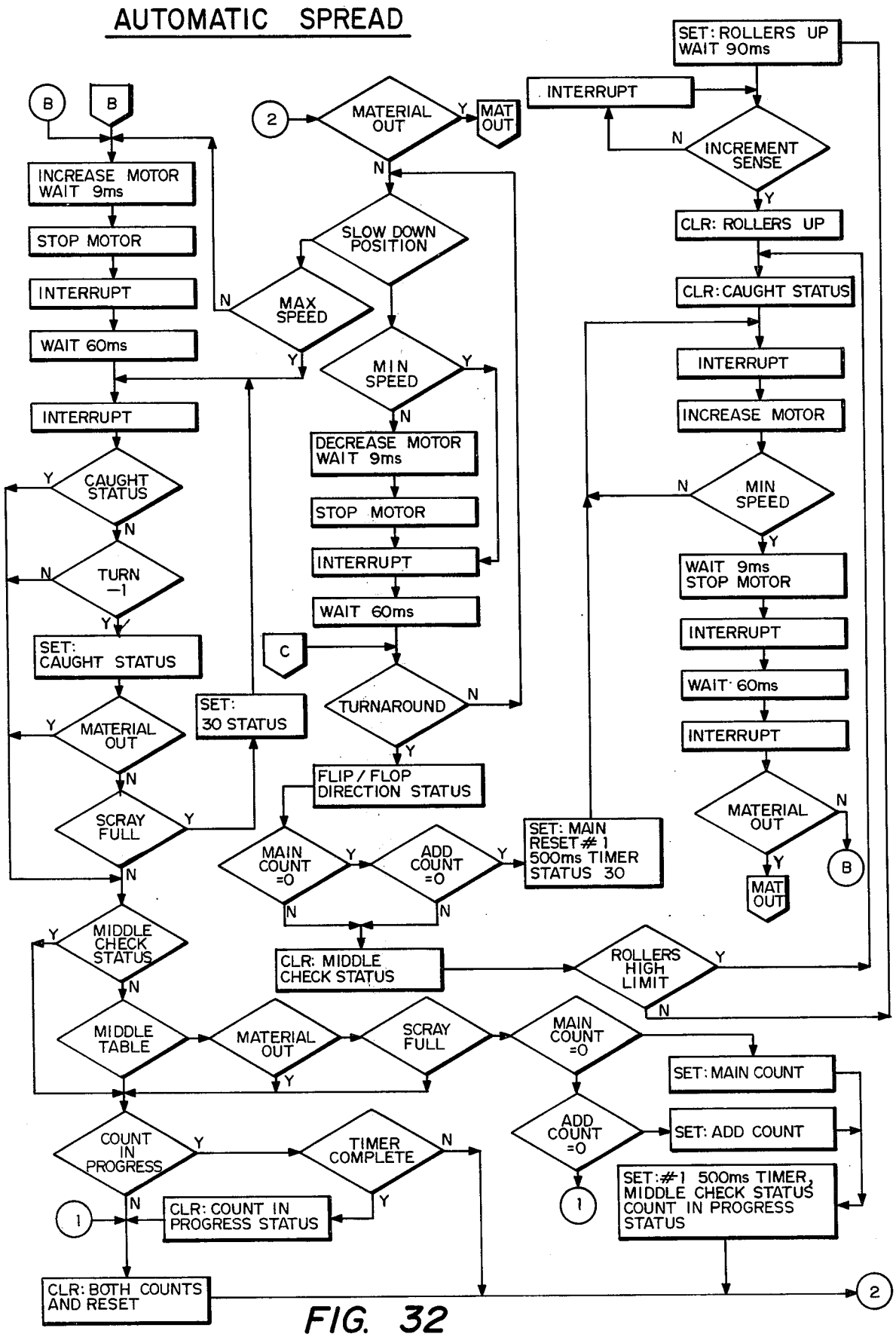
Figures 33A, 33B, 33C:
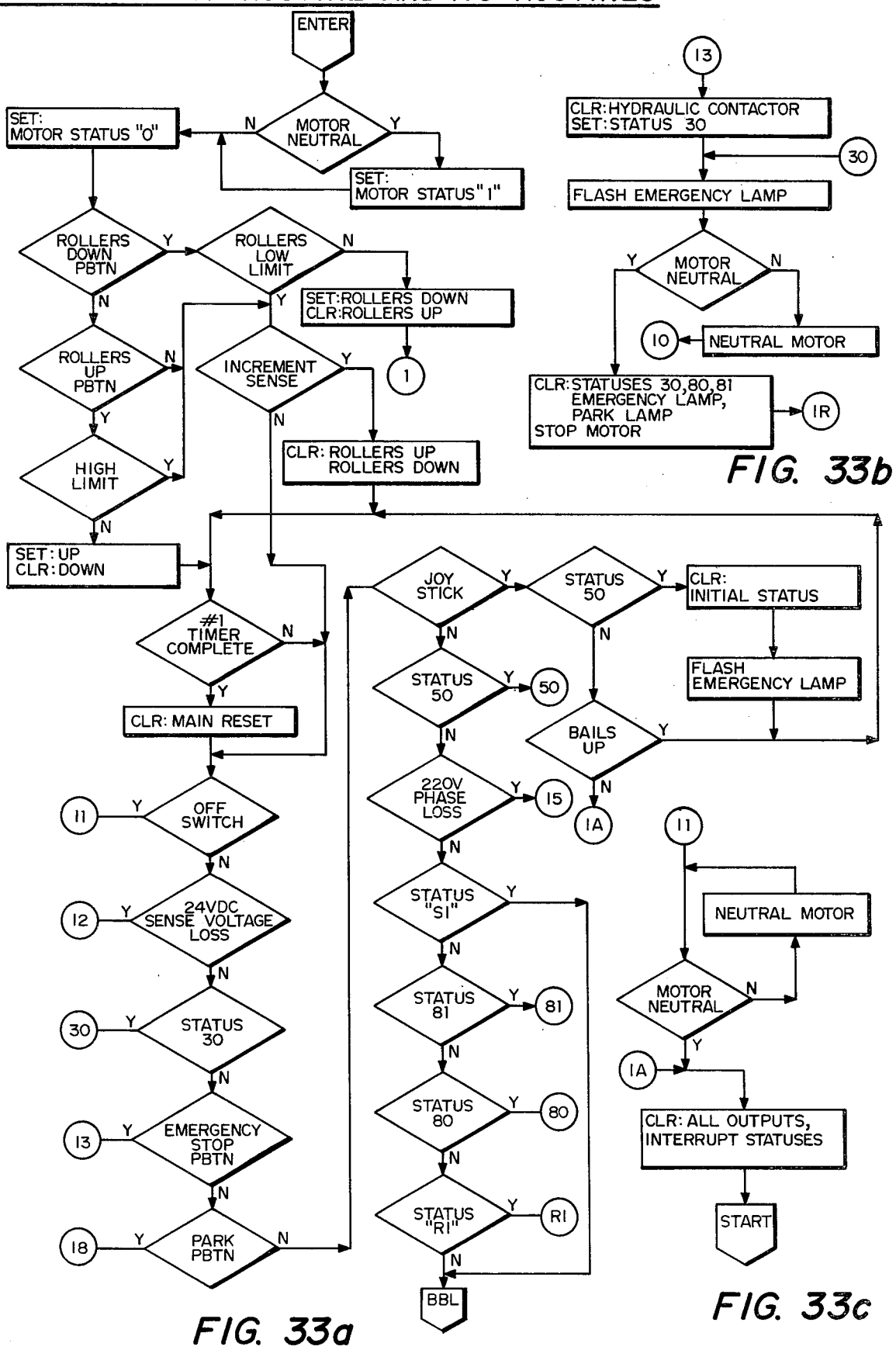
Figure 33D:
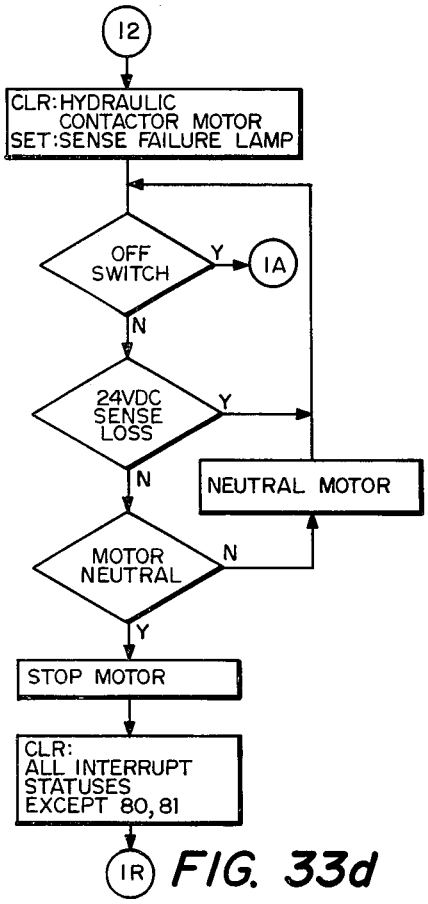
Figure 33E:
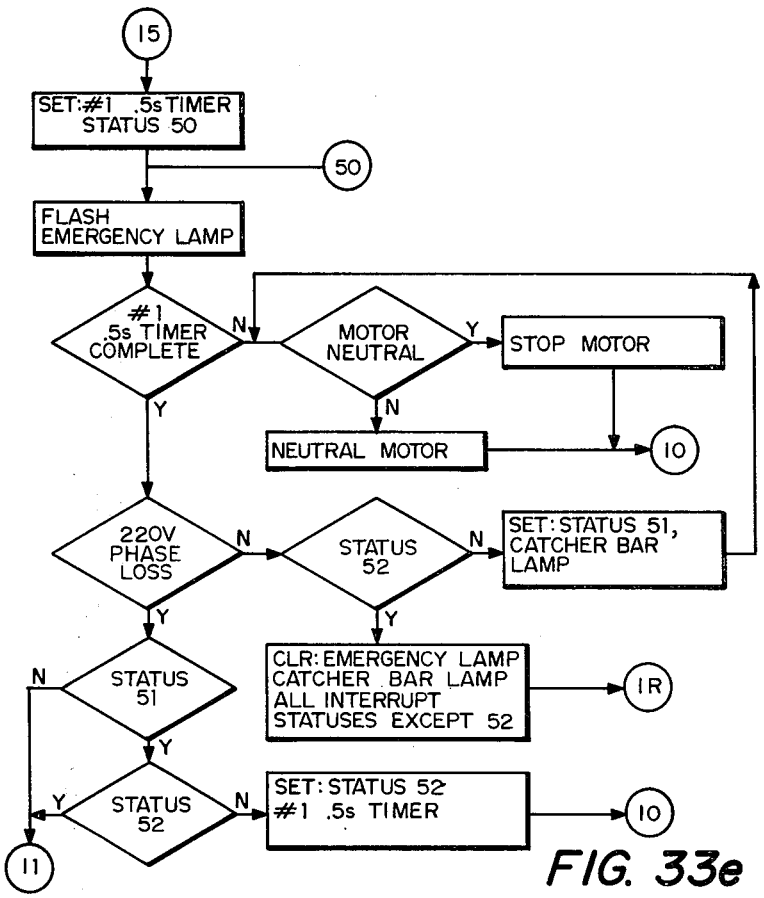
Figure 33F:
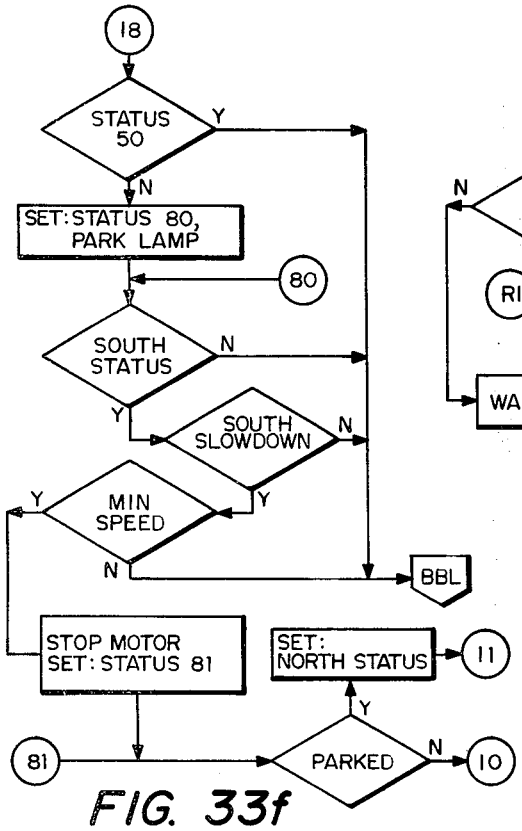
Figure 33G:
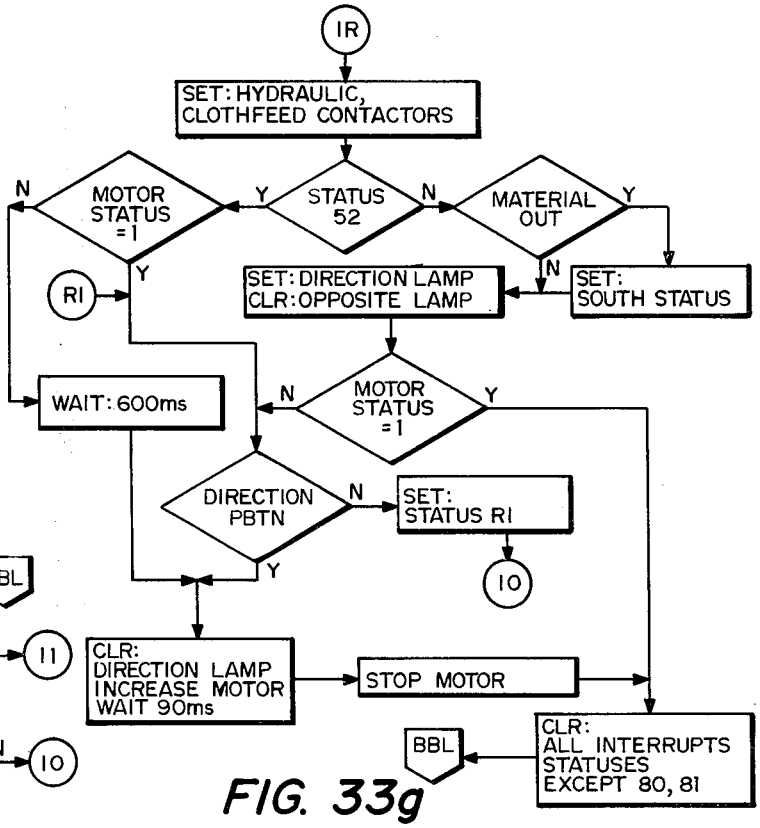

Referring now to FIGS. 11 and 12, there is shown a first modification of storage and loading portion 12 in system 10. For clarity, cross member 122 and chain hoist 124 have been omitted from FIGS. 11 and 12. In accordance with the preferred construction, storage and loading portion 12 is provided with safety assembly 350. The purpose of safety assembly 350 is to prevent the hazardous descent of a bolt 8 through opening 60 in mezzanine 16. The provision of safety assembly 350 affords failsafe protection for personnel working around spreading portion 14.

The safety assembly 350 is mounted between escapement assembly 24 and elevator assembly 26. Safety assembly 350 includes a trap door 352 mounted in opening 60 between side channels 114. Trap door 352 pivots about pin 354 for movement between a generally horizontal position as shown in FIG. 11 in which opening 60 is blocked, and a generally vertical position as shown in FIG. 12 in which opening 60 is clear.

Chains 356 connect trap door 352 to cross member 358. One chain 356 is provided for each side of trap door 352. Cross member 358 is rollingly supported between uprights 104 for vertical movement. FIG. 12 shows cross member 358 in the down position resting upon adjustable limit stops 359. Each chain 356 extends around sprockets 360, 362 and 364. Sprockets 360 are rotatably supported at the sides of opening 60 and are positioned closest to trap door 352. Sprockets 362 are rotatably secured to fixed side plates 70 of escapement assembly 24. Sprockets 364 are mounted for movement with cross member 358. The top ends of chains 356 are fixedly secured to uprights 104. It will thus be understood that raising or lowering cross member 358 causes pivotal movement of trap door 352 with chains 356.

Fence assembly 366 is positioned beneath cross member 358 and is also mounted for vertical movement. Fence assembly 366 comprises a top plate 367 spanning side plates 368, and a bottom plate 370, all of which extend between uprights 104. FIG. 12 depicts fence assembly 366 in the down position resting upon stops 371 with bottom plate 370 blocking the discharge end of conveyor 22. Fence assembly 366 also includes a pair of projecting dogs 372. In addition, a latch 374 is provided on each upright 104 to selectively lock fence assembly 366 in the up position. Latches 374 are actuated by cylinders 376. Preferably, cylinders 376 are of the double acting pneumatic type. Selective actuation of cylinders 376 pivots latches 374 out of interference with fence assembly 366. In accordance with the preferred construction, a predetermined pressure is maintained in cylinders 376 so that the cylinders function as air springs to resiliently maintain latches 374 in the extended position.

In using safety assembly 350, a pair of dogs 378 are provided on elevator assembly 326. As shown in FIG.

11, trap door 352 is closed and fence assembly 366 is latched in the up position during loading of carriage 110 in elevator assembly 26. Following the loading of a bolt 18, carriage 110 moves upward engaging dogs 372 with dogs 378 to lift fence assembly 366 off latches 374. Latches 374 are then retracted to permit descent of cross member 358 and fence assembly 366 with carriage 110. It will thus be apparent that trap door 352 is opened by chains 356, as fence assembly 366 comes down to block the discharge end of conveyor 22. Following reloading of carriage 28, elevator carriage 110 moves upward past open trap door 352 so that dogs 372 and 378 again engage. Fence assembly 366 and cross member 358 are thus raised as trap door 352 is drawn shut. The elevator carriage 110 pushes fence assembly 366 past latches 374 and continues to move upward to a position wherein arms 134 can pivot backward to drop arbor 20' into receptacle 31. As elevator carriage 110 lowers to a position for receiving another bolt 18, fence assembly 366 is locked in the up position by latches 374.

It will thus be understood that safety assembly 350, in its preferred form, blocks either the end of conveyor 22 or opening 60 in mezzanine 16 at substantially all times. The inadvertent advancement of a heavy bolt 18 through opening 60 is thus prevented in a failsafe manner. If desired, safety assembly 350 could be utilized without bottom plate 370 in fence assembly 366 to obstruct the discharge end of conveyor 22. Should downward movement of fence assembly 366 become snagged, it will be apparent that elevator carriage 110 will force trap door 352 open. Preferably, elevator assembly 26 is provided with a safety switch (not shown) to interrupt operation of system 10 in the event chains 356 go slack or fence assembly 366 becomes rigidly obstructed.

Referring now to FIGS. 14–33, there are shown the logic flowcharts employed in accomplishing the operations of system 10 hereinabove described. Explanations of the abbreviations found in FIGS. 14–33 are set out in the tables comprising FIGS. 13*a, b, c* and *d*. The detailed flowcharts represent instructions programmed into the microprocessor located in cabinet 156 of carriage 28. Any suitable microprocessor of sufficient capacity can be utilized. In actual practice, a microprocessor made by Intel Corporation of California and packaged by the Prolog Corporation has been satisfactory. The logic flowcharts are extensively set out in conventional fashion and are entirely self-explanatory. Complete disclosure of the logic and structure employed in the invention is sufficient to enable one with ordinary skill in the art to make and use system 10.

In view of the foregoing, it will be understood that the present invention comprises an automatic system for spreading flexible material which incorporates numerous advantages over the prior art. One advantage of the present invention involves the elimination of numerous manual or at best semi-automatic operations which were heretofore required in properly arranging multiple layers of material. The reload capability of the invention involves another advantage in that materials from several bolts can be rapidly spread in succession with but brief interruptions to reload the spreader carriage. The feature of a false table surface over which the material is spread enables the next spreading operation to proceed during advancement of the previously spread layers of material into a subsequent work station. During spreading, a tensionless loop is maintained between the unrolling material and the table surface and is utilized to coordinate material feed and carriage travel rates. The catcher assemblies are pivotally supported to engage the material evenly across the width of each end loop. The safety assembly protects personnel and equipment from a bolt of material inadvertently falling from the storage and loading portion of the system. Other advantages of the invention will readily suggest themselves to those skilled in the art.

Although particular embodiments of the invention have been illustrated in the accompanying Drawings and described in the foregoing Detailed Description, it will be understood that the application is not limited to the embodiments disclosed, but is intended to embrace any alternatives, modifications, and rearrangements and/or substitutions of parts or elements as fall within the spirit and scope of the invention.

What is claimed is:

1. A system for spreading material from a bolt of material, which comprises:

a spreading portion including fixed table means of predetermined length, carriage means supported for selectively reciprocable movement over the table for depositing material from the bolt of material carried by the carriage means in successive layers over the table means, and first and second catcher cutter means mounted in spaced relationship on the table with each of said catcher cutter means including pivotal catcher bars for selectively engaging and then severing each end loop of material formed upon direction reversal of the carriage means;

a storage and loading portion including conveyor means for storing a plurality of bolts of material, and elevator means for transporting individual bolts of material received from the conveyor means into proximity with the carriage means to selectively effect reloading of the carriage means after depletion of the bolt of material carried thereby; and processing means coupled to the spreading portion and the storage and loading portion for controlling operation of the system.

2. In a system for spreading material from a bolt of material carried by a carriage mounted for reciprocable movement over a fixed table, the improvement comprising:

an S shaped scray mounted on the carriage, said material being fed into the scray from the bolt of material and forming a loop therein before exiting the scray to be spread over the table;

a pair of output rollers supported on the carriage between the scray and the table;

said output rollers being selectively supported at a predetermined height over the table responsive to a preselected number of reciprocations of the carriage thereon;

photosensor means positioned substantially vertically adjacent the scray for detecting the length of the material loop and thus the amount of material maintained in the scray;

said material feed rate of input into the scray and material spread rate of output from the scray both being responsive to the photosensor means so as to maintain a tensionless loop in the material during the spreading operation; and a pair of catcher means responsive to positioning of the carriage and mounted in spaced relationship along the table for catching and subsequently severing the end loops of material formed with each reversal of the carriage.

3. A system for automatically spreading multiple layers of flexible material from a bolt of material, which comprises:

a fixed, elongate table having an upper surface over which the material is spread;

a carriage supported for movement over the table;

variable speed drive means for reciprocating said carriage over said table;

said carriage including a bolt of material rotatably supported thereon and guide structure for transporting material from the bolt of material into proximity with the table;

variable speed feed means mounted on the carriage for advancing the material from the bolt of material into the guide structure;

said material feed means and carriage drive means being interresponsive so as to maintain a tensionless loop of material in a portion of the guide structure during the spreading operation;

a pair of catcher means attached in spaced relationship to the table and defining therebetween a predetermined material spread length, each of said catcher means including a pair of pivotal bars responsive to predetermined positioning of the carriage to restrain each end loop interconnecting successive layers of material formed upon each reversal of the carriage, and cutting means cooperating with each pair of pivotal bars in each catcher means to subsequently sever each restrained end loop of material; and processing means coupled to the carriage and both catcher means for controlling operation of the system.

4. The system according to claim 3, wherein the upper table surface comprises a plurality of removable members, and further including:

an endless belt mounted for rotation about a course beneath the table surface so that spread layers of material can be repositioned from the upper table surface onto the endless belt and advanced during spreading of the next layers of material.

5. The system according to claim 3, wherein the guide structure on the carriage includes:

a pair of spaced arms pivotally attached at the proximate ends to the carriage; and a pair of rollers mounted for rotation between the distal ends of said arms, between which rollers said material is transported into adjustable proximity with the table.

6. The system of claim 5, further including:

a wheel mounted for rotation at the distal end of each of said arms; and ramp means positioned adjacent each catcher means for engaging said wheels so that the material is spread over a portion of the catcher means before each reversal of the carriage.

7. The system of claim 5, further including:

means connected to each of said arms for incrementally controlling downmost pivotal movement responsive to a preselected number of reciprocations of the carriage over the table.

8. The system according to claim 3, wherein the carriage straddles the table and is supported for rolling movement by wheel means positioned at each corner thereof, and wherein the drive means comprises a hydrostatic system including a motor driven pump, and a hydraulic motor connected to each wheel means and responsive to the pump for effecting rotation of the wheel means to propel the undercarriage.

9. The system according to claim 3, further including:

a stationary guide rail extending parallel to the table; and a pair of rollers secured to the carriage for engaging the guide rail therebetween during movement of the carriage.

10. The system according to claim 3, further including:

stationary power rail means extending parallel to the table; and tower means mounted on the carriage and engaging the power rail means for providing power for the material feed means and the carriage drive means.

11. The system according to claim 3, further including:

first photosensor means positioned across the portion of the guide structure wherein the tensionless loop of material is maintained for sensing changes in the length of said material loop;

said material feed means and carriage drive means being responsive to the first photosensor means; and second photosensor means positioned across the material feed path from the bolt of material for sensing depletion of the bolt of material, said drive means being responsive thereto to subsequently halt movement of the carriage.

12. The system according to claim 3, further including:

a fixed chain extending along the table at least between the catcher means;

sprocket means mounted for rotation on the carriage and enmeshed with said chain; and means for measuring rotation of said sprocket means responsive to movement of the carriage corresponding to the position of said carriage along the table;

said drive means being responsive to the measuring means to effect reversal of the carriage substantially over each catcher means.

13. The system according to claim 3 wherein one of the catcher means is demountably attached to the table so that the material spread length can be varied.

14. The system according to claim 3, further including:

conveyor means positioned above the table for storing a plurality of bolts of material;

elevator means located adjacent one end of the conveyor means and mounted for substantially vertical movement;

shuttle means positioned between the conveyor and the elevator means for selectively transferring a bolt of material from the conveyor to the elevator means; and means for selectively actuating the elevator means to reload the carriage.

15. A system for automatically spreading multiple layers of material from a bolt of flexible material carried on an arbor, comprising:

an elongate, stationary table with an upper surface over which the material is spread;

a carriage straddling the table and supported for movement therealong;

cradle means on the carriage for rotatably supporting a bolt of material on an arbor;

structure for guiding material from the bolt along a predetermined path into proximity with the upper table surface;

said structure including a scray portion in which a predetermined length of material can hang in a loop;

photosensor means positioned adjacent said scray portion for detecting changes in the length of material hanging in a loop therein;

variable speed material feed means responsive to the photosensor means for advancing material from the bolt into the guiding structure;

first and second catcher means mounted in spaced relationship on the table and defining therebetween a preselected material spread length;

variable speed carriage drive means responsive to the photosensor means for reciprocating the carriage over the table between the first and second catcher means while maintaining a substantially tensionless loop of material in the scray during withdrawal of material from the guiding structure to effect spreading;

each of said catcher means including a pair of pivotal bars for restraining thereabout the loop interconnecting successive layers of material formed with each direction reversal of the carriage, and cutting means cooperating with the pivotal bars for subsequently separating each restrained end loop of material;

means to which the carriage drive means is responsive for sensing the position of the carriage relative to the table and each catcher means;

load conveyor means disposed above the table for storing a plurality of bolts of material with arbors therethrough;

elevator means including structure for transporting a bolt of material on an arbor between a first position next to the load conveyor means and a second position near the table and first catcher means;

means for selectively transferring a bolt of material on an arbor from the load conveyor means to the elevator means; and means for selectively actuating the elevator means to effect reloading of the carriage.

16. The system according to claim 15 wherein the second catcher means is removably secured to the table thereby permitting the predetermined material spread length to be changed.

17. The system according to claim 15, further including second photosensor means positioned between the elevator and conveyor means for detecting a bolt of material not having an arbor therethrough.

18. The system according to claim 15, further including a safety assembly comprising:

a trap door supported for pivotal movement into and out of the path of the elevator means responsive to movement of the elevator means for preventing the fall of a bolt of material from the load conveyor means to the table.

19. The system according to claim 15, further including a safety assembly comprising:

fence means mounted for movement into and out of obstructing relationship with the discharge end of the load conveyor means responsive to movement of the elevator means;

trap door means supported for pivotal movement into and out of obstructing relationship with the path of the elevator means; and means interconnecting the fence means and the trap door means so that the fence means is out of obstructing relationship and the trap door means is in obstructing relationship when the elevator assembly is located in the first position, and so that the fence means is in obstructing relationship and the trap door means is out of obstructing relationship when the elevator assembly is not in the first position.

20. The system according to claim 15 wherein the structure on the carriage for guiding material from the bolt into proximity with the table includes:

a pair of output rollers pivotally supported on the carriage between the scray and the table; and means connected to said output rollers for incrementally controlling downmost pivotal positioning thereof responsive to a preselected number of reciprocations of the carriage over the table so that the material is guided between said output rollers into predetermined proximity with the table.

21. A method of spreading flexible material from a supply roll in successive layers over a spreading surface, comprising the steps of:

(a) a rotatably supporting a supply roll on a movable carriage;

(b) reciprocating the carriage over the spreading surface;

(c) continuously sensing the position of the carriage along the spreading surface;

(d) simultaneously advancing material from the supply roll on the carriage;

(e) maintaining a tensionless loop in the material advanced from the supply roll;

(f) guiding and releasing the material advanced from the supply roll a variable predetermined distance above the spreading surface;

(g) continuously sensing the length of the tensionless loop;

(h) engaging the end loops of material formed with each turnaround of the carriage;

(i) subsequently individually severing the end loops of material to disconnect each layer from the supply roll; and (j) controlling both movement of the carriage and advancement of material from the supply roll in accordance with the position of the carriage and the length of the tensionless loop.

22. The method of claim 21, including the steps of:

continuously sensing the number of reciprocations of the carriage; and adjusting the distance between the spreading surface and the material advanced from the supply roll in accordance with a predetermined number of reciprocations of the carriage.

23. The method of claim 21, wherein step (h) comprises the steps of:

mounting two pairs of pivotal catcher bars at spaced locations along the spreading surface;

pivoting one pair of catcher bars into substantially transverse alignment over the previously spread layer of material and prior to each turnaround of the carriage.

24. The method according to claim 23, including after step (i) the steps of:

pivoting the said one pair of catcher bars out of engagement with the disconnected layer of material subsequent to each turnaround of the carriage; and subsequently pivoting the said one pair of catcher bars into substantially parallel longitudinal relationship prior to the next turnaround of the carrige.

25. The method of claim 21, including the steps of:

sensing depletion of the supply roll on the carriage;

subsequently halting the carriage at a predetermined parking location along the spreading surface; and automatically replacing the depleted supply roll on the carriage with another supply roll.

26. The method according to claim 25, wherein the step of automatically replacing the depleted supply roll comprises the steps of:

loading a predetermined number of supply rolls onto a conveyor;

selectively advancing the conveyor and the supply rolls thereon;

transferring one supply roll from the conveyor to a movable elevator;

transporting the said one supply roll on the elevator into proximity with the parked carriage;

transferring the depleted supply roll from the carriage to the elevator; and subsequently transferring the said one supply roll from the elevator to the carriage.

27. A method of automatically spreading flexible material from supply rolls thereof in successive layers over a spreading surface, comprising the steps of:

(a) rotatably supporting a supply roll on a movable carriage;

(b) reciprocating the carriage over the spreading surface;

(c) continuously sensing the location of the carriage along the spreading surface;

(d) simultaneously advancing material from the supply roll on the carriage;

(e) maintaining a tensionless loop in the material advanced from the supply roll;

(f) guiding and releasing the advanced material from said carriage at a predetermined distance above the spreading surface;

(g) continuously sensing the length of the tensionless loop;

(h) engaging the end loop of material formed with each turnaround of the carriage;

(i) subsequently individually severing the end loops of material to disconnect each layer from the supply roll;

(j) controlling both movement of the carriage and advancement of material from the supply roll thereon in accordance with the location of the carriage and the length of the tensionless loop;

(k) sensing depletion of the supply roll on the carriage;

(l) subsequently halting the carriage at a predetermined parking location along the spreading surface; and (m) automatically replacing the depleted supply roll on the carriage with another supply roll and resuming the spreading operation.

28. The method of claim 27, including the steps of:

continuously sensing the number of reciprocations of the carriage; and automatically increasing the discharge distance of the material above the spreading surface in accordance with a predetermined number of carriage reciprocations.

29. The method of claim 27, wherein step (h) comprises the steps of:

mounting two pairs of pivotal catcher bars at spaced locations along the spreading surface;

pivoting one pair of catcher bars into substantially transverse alignment prior to each turnaround of the carriage.

30. The method according to claim 29, including the steps of:

pivoting the said one pair of catcher bars out of engagement with the disconnected layer of material; and subsequently pivoting the said one pair of catcher bars into substantially parallel longitudinal relationship prior to the next turnaround of the carriage.

31. The method of claim 27 wherein step (m) comprises the steps of:

loading a predetermined number of supply rolls onto a conveyor;

selectively advancing the conveyor and the supply rolls thereon;

transferring individual rolls from the conveyor to a movable elevator;

transporting the said one supply roll on the elevator into proximity with the parked carriage;

transferring the depleted roll to the elevator from the carriage; and subsequently transferring the said one supply roll to the carriage from the elevator.

* * * * *